US011236412B2

(12) United States Patent
Sano et al.

(10) Patent No.: US 11,236,412 B2
(45) Date of Patent: *Feb. 1, 2022

(54) STEEL SHEET AND PLATED STEEL SHEET

(71) Applicant: NIPPON STEEL CORPORATION, Tokyo (JP)

(72) Inventors: Kohichi Sano, Tokyo (JP); Makoto Uno, Tokyo (JP); Ryoichi Nishiyama, Tokyo (JP); Yuji Yamaguchi, Tokyo (JP); Natsuko Sugiura, Tokyo (JP); Masahiro Nakata, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 374 days.

This patent is subject to a terminal disclaimer.

(21) Appl. No.: 16/315,120

(22) PCT Filed: Aug. 4, 2017

(86) PCT No.: PCT/JP2017/028477

§ 371 (c)(1),
(2) Date: Jan. 3, 2019

(87) PCT Pub. No.: WO2018/026014

PCT Pub. Date: Feb. 8, 2018

(65) Prior Publication Data

US 2019/0226061 A1 Jul. 25, 2019

(30) Foreign Application Priority Data

Aug. 5, 2016 (JP) ..... JP2016-155100

(51) Int. Cl.

| | |
|---|---|
| ***C21D 9/46*** | (2006.01) |
| ***C22C 38/38*** | (2006.01) |
| ***C22C 38/00*** | (2006.01) |
| ***C22C 38/58*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/26*** | (2006.01) |
| ***C22C 38/28*** | (2006.01) |
| ***C23C 2/06*** | (2006.01) |
| ***C23C 2/40*** | (2006.01) |
| *C21D 8/02* | (2006.01) |

(52) U.S. Cl.

CPC ..... *C22C 38/38* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C22C 38/28* (2013.01); *C22C 38/58* (2013.01); *C23C 2/06* (2013.01); *C23C 2/40* (2013.01); *C21D 8/0205* (2013.01); *C21D 8/0226* (2013.01); *C21D 8/0236* (2013.01); *C21D 9/46* (2013.01); *C21D 2201/05* (2013.01); *C21D 2211/002* (2013.01); *C21D 2211/005* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 4,501,626 | A | 2/1985 | Sudo et al. | |
| 6,251,198 | B1 | 6/2001 | Koo et al. | |
| 6,254,698 | B1 | 7/2001 | Koo et al. | |
| 6,589,369 | B2 | 7/2003 | Yokoi et al. | |
| 7,662,243 | B2 | 2/2010 | Yokoi et al. | |
| 7,749,338 | B2 | 7/2010 | Yokoi et al. | |
| 8,353,992 | B2 | 1/2013 | Sugiura et al. | |
| 10,889,879 | B2 * | 1/2021 | Sano | C23C 2/40 |
| 2002/0036035 | A1 | 3/2002 | Kashima et al. | |
| 2003/0063996 | A1 | 4/2003 | Funakawa et al. | |
| 2003/0084973 | A1 | 5/2003 | Issartel et al. | |
| 2004/0074573 | A1 | 4/2004 | Funakawa et al. | |
| 2005/0150580 | A1 | 7/2005 | Akamizu et al. | |
| 2006/0081312 | A1 | 4/2006 | Yokoi et al. | |

(Continued)

FOREIGN PATENT DOCUMENTS

| | | | |
|---|---|---|---|
| CA | 2882333 | A1 | 4/2014 |
| CA | 2944863 | A1 | 10/2015 |

(Continued)

OTHER PUBLICATIONS

International Preliminary Report on Patentability and English translation of the Written Opinion of the International Searching Authority for International Application No. PCT/JP2017/028477, dated Feb. 14, 2019.

(Continued)

*Primary Examiner* — Jophy S. Koshy

(74) *Attorney, Agent, or Firm* — Birch, Stewart, Kolasch & Birch, LLP

(57) ABSTRACT

A steel sheet has a specific chemical composition and has a structure represented by, by area ratio, ferrite: 30 to 95%, and bainite: 5 to 70%. When a region that is surrounded by a grain boundary having a misorientation of 15° or more and has a circle-equivalent diameter of 0.3 μm or more is defined as a crystal grain, the proportion of crystal grains each having an intragranular misorientation of 5 to 14° to all crystal grains is 20 to 100% by area ratio. An average aspect ratio of ellipses equivalent to the crystal grains is 5 or less. An average distribution density of the total of Ti-based carbides and Nb-based carbides each having a grain size of 20 nm or more on ferrite grain boundaries is 10 carbides/μm or less.

8 Claims, 2 Drawing Sheets

(56) References Cited

U.S. PATENT DOCUMENTS

| | | | | |
|---|---|---|---|---|
| 2006/0266445 | A1 | 11/2006 | Yokoi et al. | |
| 2009/0050243 | A1 | 2/2009 | Satou et al. | |
| 2009/0050244 | A1 | 2/2009 | Nakagawa et al. | |
| 2009/0092514 | A1 | 4/2009 | Asahi et al. | |
| 2009/0214377 | A1 | 8/2009 | Hennig et al. | |
| 2010/0047617 | A1 | 2/2010 | Sugiura et al. | |
| 2010/0108200 | A1 | 5/2010 | Futamura et al. | |
| 2010/0108201 | A1 | 5/2010 | Yokoi et al. | |
| 2010/0310819 | A1 | 12/2010 | Kaneko et al. | |
| 2011/0017360 | A1 | 1/2011 | Yoshinaga et al. | |
| 2011/0024004 | A1 | 2/2011 | Azuma et al. | |
| 2011/0297281 | A1 | 12/2011 | Satou et al. | |
| 2012/0012231 | A1 | 1/2012 | Murakami et al. | |
| 2012/0018028 | A1 | 1/2012 | Shimamura et al. | |
| 2012/0031528 | A1 | 2/2012 | Hayashi et al. | |
| 2013/0000791 | A1 | 1/2013 | Takahashi et al. | |
| 2013/0087254 | A1 | 4/2013 | Funakawa et al. | |
| 2013/0276940 | A1 | 10/2013 | Nakajima et al. | |
| 2013/0284321 | A1 | 10/2013 | Bocharova et al. | |
| 2013/0319582 | A1 | 12/2013 | Yokoi et al. | |
| 2014/0000765 | A1 | 1/2014 | Nozaki et al. | |
| 2014/0014236 | A1 | 1/2014 | Nozaki et al. | |
| 2014/0014237 | A1 | 1/2014 | Yokoi et al. | |
| 2014/0027022 | A1 | 1/2014 | Yokoi et al. | |
| 2014/0087208 | A1 | 3/2014 | Toda et al. | |
| 2014/0110022 | A1 | 4/2014 | Sano et al. | |
| 2014/0193665 | A1 | 7/2014 | Kawata et al. | |
| 2014/0255724 | A1 | 9/2014 | Yamanaka et al. | |
| 2014/0287263 | A1 | 9/2014 | Kawata et al. | |
| 2014/0290807 | A1 | 10/2014 | Goto et al. | |
| 2015/0004433 | A1 | 1/2015 | Tanaka et al. | |
| 2015/0030879 | A1 | 1/2015 | Kosaka et al. | |
| 2015/0071812 | A1 | 3/2015 | Kawano et al. | |
| 2015/0101717 | A1 | 4/2015 | Kosaka et al. | |
| 2015/0191807 | A1 | 7/2015 | Hanlon et al. | |
| 2015/0203949 | A1 | 7/2015 | Yokoi et al. | |
| 2015/0218708 | A1 | 8/2015 | Maruyama et al. | |
| 2015/0322552 | A1 | 11/2015 | Takashima et al. | |
| 2016/0017465 | A1 | 1/2016 | Toda et al. | |
| 2017/0349967 | A1 | 12/2017 | Yokoi et al. | |
| 2018/0023162 | A1 | 1/2018 | Sugiura et al. | |
| 2018/0037967 | A1 | 2/2018 | Sugiura et al. | |
| 2018/0037980 | A1 | 2/2018 | Wakita et al. | |
| 2018/0044749 | A1 | 2/2018 | Shuto et al. | |
| 2019/0226061 | A1 | 7/2019 | Sano et al. | |
| 2019/0233926 | A1 | 8/2019 | Sano et al. | |
| 2019/0241996 | A1* | 8/2019 | Sano | C22C 38/28 |
| 2019/0309398 | A1* | 10/2019 | Sano | C22C 38/14 |

FOREIGN PATENT DOCUMENTS

| | | | |
|---|---|---|---|
| CN | 1450191 | A | 10/2003 |
| CN | 101443467 | A | 5/2009 |
| CN | 101646794 | A | 2/2010 |
| CN | 101724776 | A | 6/2010 |
| CN | 101999007 | A | 3/2011 |
| CN | 103459647 | A | 12/2013 |
| CN | 103459648 | A | 12/2013 |
| CN | 104011234 | A | 8/2014 |
| CN | 107250411 | A | 10/2017 |
| EP | 1149925 | A1 | 10/2001 |
| EP | 1350859 | A1 | 10/2003 |
| EP | 1559797 | A1 | 8/2005 |
| EP | 2088218 | A1 | 8/2009 |
| EP | 2182080 | A1 | 5/2010 |
| EP | 2453032 | A1 | 5/2012 |
| EP | 2530180 | A1 | 12/2012 |
| EP | 2599887 | A | 6/2013 |
| EP | 2631314 | A1 | 8/2013 |
| EP | 2865778 | A1 | 4/2015 |
| JP | 57-70257 | A | 4/1982 |
| JP | 58-42726 | A | 3/1983 |
| JP | 61-217529 | A | 9/1986 |
| JP | 2-149646 | A | 6/1990 |
| JP | 3-180445 | A | 8/1991 |
| JP | 4-337026 | A | 11/1992 |
| JP | 5-59429 | A | 3/1993 |
| JP | 5-163590 | A | 6/1993 |
| JP | 7-90478 | A | 4/1995 |
| JP | 9-49026 | A | 2/1997 |
| JP | 10-195591 | A | 7/1998 |
| JP | 2001-200331 | A | 7/2001 |
| JP | 2001-220648 | A | 8/2001 |
| JP | 2001-303186 | A | 10/2001 |
| JP | 2002-105595 | A | 4/2002 |
| JP | 2002-161340 | A | 6/2002 |
| JP | 2002-226943 | A | 8/2002 |
| JP | 2002-317246 | A | 10/2002 |
| JP | 2002-534601 | A | 10/2002 |
| JP | 2002-322540 | A | 11/2002 |
| JP | 2002-322541 | A | 11/2002 |
| JP | 2003-342684 | A | 12/2003 |
| JP | 2004-218077 | A | 8/2004 |
| JP | 2004-250749 | A | 9/2004 |
| JP | 2004-315857 | A | 11/2004 |
| JP | 2005-82841 | A | 3/2005 |
| JP | 2005-213566 | A | 8/2005 |
| JP | 2005-220440 | A | 8/2005 |
| JP | 2005-256115 | A | 9/2005 |
| JP | 2005-298924 | A | 10/2005 |
| JP | 2005-320619 | A | 11/2005 |
| JP | 2006-274318 | A | 10/2006 |
| JP | 2007-9322 | A | 1/2007 |
| JP | 2007-138238 | A | 6/2007 |
| JP | 2007-231399 | A | 9/2007 |
| JP | 2007-247046 | A | 9/2007 |
| JP | 2007-247049 | A | 9/2007 |
| JP | 2007-314828 | A | 12/2007 |
| JP | 2008-266726 | A | 11/2008 |
| JP | 2008-285748 | A | 11/2008 |
| JP | 2009-19265 | A | 1/2009 |
| JP | 2009-24227 | A | 2/2009 |
| JP | 2009-191360 | A | 8/2009 |
| JP | 2009-270171 | A | 11/2009 |
| JP | 2009-275238 | A | 11/2009 |
| JP | 2010-168651 | A | 8/2010 |
| JP | 2010-202976 | A | 9/2010 |
| JP | 2010-248601 | A | 11/2010 |
| JP | 2010-255090 | A | 11/2010 |
| JP | 2011-140671 | A | 7/2011 |
| JP | 2011-225941 | A | 11/2011 |
| JP | 2012-26032 | A | 2/2012 |
| JP | 2012-41573 | A | 3/2012 |
| JP | 2012-62561 | A | 3/2012 |
| JP | 2012-180569 | A | 9/2012 |
| JP | 2012-251201 | A | 12/2012 |
| JP | 2013-19048 | A | 1/2013 |
| JP | 5240037 | B2 | 7/2013 |
| JP | 2014-37595 | A | 2/2014 |
| JP | 5445720 | B1 | 3/2014 |
| JP | 2014-141703 | A | 8/2014 |
| JP | 5574070 | B1 | 8/2014 |
| JP | 5610103 | B2 | 10/2014 |
| JP | 2015-124411 | A | 7/2015 |
| JP | 2015-218352 | A | 12/2015 |
| JP | 2016-50334 | A | 4/2016 |
| KR | 10-2003-0076430 | A | 9/2003 |
| KR | 10-0778264 | B1 | 9/2003 |
| KR | 10-2009-0086401 | A | 8/2009 |
| TW | 201245465 | A1 | 11/2012 |
| TW | 201332673 | A1 | 8/2013 |
| TW | 201413009 | A | 4/2014 |
| TW | I467027 | B | 1/2015 |
| TW | I470091 | B | 1/2015 |
| WO | WO 2007/132548 | A1 | 11/2007 |
| WO | WO 2008/056812 | A1 | 5/2008 |
| WO | WO 2008/123366 | A1 | 10/2008 |
| WO | WO 2010/131303 | A1 | 11/2010 |
| WO | WO 2013/121963 | A1 | 8/2013 |
| WO | WO 2013/150687 | A1 | 10/2013 |
| WO | WO 2013/161090 | A1 | 10/2013 |
| WO | WO 2014/014120 | A1 | 1/2014 |
| WO | WO 2014/019844 | A1 | 2/2014 |

(56) References Cited

FOREIGN PATENT DOCUMENTS

| | | | | |
|---|---|---|---|---|
| WO | WO 2014/051005 A1 | 4/2014 | | |
| WO | WO 2014/171427 A1 | 10/2014 | | |
| WO | WO-2016135896 A1 * | 9/2016 | ..... | C22C 38/26 |

OTHER PUBLICATIONS

"Development of Production Technology for Ultra Fine Grained Steels", Nakayama Steel Works, Ltd., NFG Product Introduction, total 11 pages, http://www.nakayama-steel.co.jp/menu/product/nfg.html.
Chinese Office Action and Search Report for Application No. 201580076254.4, dated May 30, 2018, with an English translation.
Chinese Office Action and Search Report for Chinese Application No. 201680011657.5, dated Jun. 5, 2018, with English translation.
Chinese Office Action and Search Report, dated Jun. 25, 2018, for Chinese Application No. 201580076157.5, with an English translation of the Office Action.
Chinese Office Action and Search Report, Jun. 1, 2018, in Chinese Patent Application No. 201580075484.9, with an English translation.
English translation of the International Preliminary Report on Patentability and Written Opinion dated Aug. 31, 2017, in PCT International Application No. PCT/JP2015/054846.
English translation of the International Preliminary Report on Patentability and Written Opinion of the International Searching Authority (Forms PCT/IB/338, PCT/IB/373 and PCT/ISA/237), dated Feb. 14, 2019, for International Application No. PCT/JP2017/028478.
Extended European Search Report dated Aug. 13, 2018, in European Patent Application No. 15882644.6.
Extended European Search Report dated Dec. 11, 2018, in European Patent Application No. 16752608.6.
Extended European Search Report, dated Aug. 13, 2018, for European Application No. 15882647.9.
Extended European Search Report, dated Dec. 19, 2018, for European Application No. 16755418.7.
Extended European Search Report, dated Nov. 29, 2019, for European Application No. 17837116.7.
Extended European Search Report, dated Sep. 12, 2018, for European Application No. 15883192.5.
International Preliminary Report on Patentability and Written Opinion of the International Searching Authority (forms PCT/IB/338, PCT/IB/373 and PCT/ISA/237), dated Sep. 8, 2017, for corresponding International Application No. PCT/JP2015/055455, with a Written Opinion translation.
International Search Report (form PCT/ISA/210), dated May 19, 2015, for International Application No. PCT/JP2015/055455, with an English translation.
International Search Report for PCT/JP2015/054846 dated May 19, 2015.
International Search Report for PCT/JP2015/054860 dated May 19, 2015.
International Search Report for PCT/JP2015/054876 dated May 19, 2015.
International Search Report for PCT/JP2015/055464 dated May 19, 2015.
International Search Report for PCT/JP2016/055071 (PCT/ISA/210) dated May 17, 2016.
International Search Report for PCT/JP2016/055074 (PCT/ISA/210) dated May 17, 2016.
International Search Report for PCT/JP2017/028478 (PCT/ISA/210) dated Oct. 31, 2017.
Katoh et al., Seitetsu Kenkyu, 1984, No. 312, pp. 41-50.
Kimura et al., "Misorientation Analysis of Plastic Deformation of Austenitic Stainless Steel by EBSD and X-Ray Diffraction Methods", Transactions of the Japan Society of Mechanical Engineers. A, vol. 71, No. 712, 2005, pp. 1722-1728.
Korean Notice of Allowance, dated Feb. 26, 2019, for Korean Application No. 10-2017-7023370, with an English translation.
Korean Office Action dated Nov. 7, 2018 for Korean Application No. 10-2017-7023367, with an English translation.
Korean Office Action for Korean Application No. 10-2017-7023370, dated Nov. 7, 2018, with an English translation.
Korean Office Action, dated Oct. 12, 2018, for Korean Application No. 10-2017-7024039, with an English translation.
Notice of Allowance dated Feb. 26, 2019, in Korean Patent Application No. 10-2017-7023367, with English translation.
Office Action for TW 105105137 dated Mar. 23, 2017.
Office Action dated May 30, 2018, in Chinese Patent Application No. 201680010703.X, with English translation.
Office Action dated Sep. 3, 2018, in Korean Patent Application No. 10-2017-7018427, with English translation.
Sugimoto et al., "Stretch-flangeability of a High-strength TRIP Type Bainitic Sheet Steel", ISIJ International, 2000, vol. 40, No. 9, pp. 920-926.
Taiwanese Office Action issued in TW Patent Application No. 105105213 dated Mar. 23, 2017.
Taiwanese Office Action issued in TW Patent Application No. 105105214 dated Mar. 23, 2017.
Takahashi, "Development of High Strength Steels for Automobiles", Nippon Steel Technical Report, 2003, No. 378, pp. 2-7.
U.S. Final Office Action, dated Aug. 20, 2019, issued in U.S. Appl. No. 15/551,171.
U.S. Final Office Action, dated Dec. 10, 2019, for U.S. Appl. No. 15/549,837.
U.S. Final Office Action, dated Sep. 18, 2019, for U.S. Appl. No. 15/549,093.
U.S. Notice of Allowance, dated Dec. 27, 2019, for U.S. Appl. No. 15/551,863.
U.S. Notice of Allowance, dated Jan. 10, 2020, for U.S. Appl. No. 15/549,093.
U.S. Notice of Allowance, dated Sep. 5, 2019, for U.S. Appl. No. 15/551,863.
U.S. Office Action, dated Apr. 29, 2019, for U.S. Appl. No. 15/549,093.
U.S. Office Action, dated Apr. 29, 2019, issued in U.S. Appl. No. 15/551,171.
U.S. Office Action, dated Mar. 22, 2019, for U.S. Appl. No. 15/538,404.
U.S. Office Action, dated May 1, 2019, for U.S. Appl. No. 15/551,863.
U.S. Office Action, dated May 31, 2019, for U.S. Appl. No. 15/549,837.
U.S. Office Action, dated Nov. 18, 2019, for U.S. Appl. No. 15/538,404.
Written Opinion of the International Searching Authority for PCT/JP2015/054846 (PCT/ISA/237) dated May 19, 2015.
Written Opinion of the International Searching Authority for PCT/JP2015/054860 (PCT/ISA/237) dated May 19, 2015.
Written Opinion of the International Searching Authority for PCT/JP2015/055455 (PCT/ISA/237) dated May 19, 2015.
Written Opinion of the International Searching Authority for PCT/JP2016/055071 (PCT/ISA/237) dated May 17, 2016.
Written Opinion of the International Searching Authority for PCT/JP2016/055074 (PCT/ISA/237) dated May 17, 2016.
Written Opinion of the International Searching Authority for PCT/JP2017/028478 (PCT/ISA/237) dated Oct. 31, 2017.
International Search Report for PCT/JP2017/028477 (PCT/ISA/210) dated Oct. 31, 2017.
Written Opinion of the International Searching Authority for PCT/JP2017/028477 (PCT/ISA/237) dated Oct. 31, 2017.
U.S. Notice of Allowance, dated Apr. 17, 2020, for U.S. Appl. No. 15/551,863.
U.S. Office Action, dated Mar. 17, 2020, for U.S. Appl. No. 15/551,171.
U.S. Appl. No. 15/538,404, filed Jun. 21, 2017.
U.S. Appl. No. 15/549,093, filed Aug. 4, 2017.
U.S. Appl. No. 16/312,222, filed Dec. 20, 2018.
U.S. Appl. No. 15/549,837, filed Aug. 9, 2017.
U.S. Appl. No. 15/551,171, filed Aug. 15, 2017.
U.S. Appl. No. 15/551,863, filed Aug. 17, 2017.

(56) References Cited

OTHER PUBLICATIONS

U.S. Notice of Allowance, dated Feb. 12, 2020, for U.S. Appl. No. 15/549,093.
U.S. Office Action, dated Mar. 2, 2020, for U.S. Appl. No. 16/312,222.
Extended European Search Report for corresponding European Application No. 17837115.9, dated Nov. 28, 2019.
U.S. Office Action for U.S. Appl. No. 15/538,404, dated Aug. 24, 2021.

* cited by examiner

STEEL SHEET AND PLATED STEEL SHEET

TECHNICAL

The present invention relates to a steel sheet and a plated steel sheet.

BACKGROUND ART

Recently, the reduction in weight of various members aiming at the improvement of fuel efficiency of automobiles has beep demanded. In response to this demand, thinning achieved by an increase in strength of a steel sheet to be used for various members and application of light metal such as an Al alloy to various members have been in progress. The light metal such as an Al alloy is high in specific strength as compared to heavy metal such as steel. However, the light metal is significantly expensive as compared to the heavy metal. Therefore, the application of light metal such as an Al alloy is limited to special uses. Thus, the thinning achieved by an increase in strength of a steel sheet has been demanded in order to apply the reduction in weight of various members to a more inexpensive and broader range.

The steel sheet to be used for various members of automobiles is required to have not only strength but also material properties such as ductility, stretch-flanging workability, burring workability, fatigue-endurance, impact resistance, and corrosion resistance according to the use of a member. However, when the steel sheet is increased in strength, material properties such as formability (workability) deteriorate generally. Therefore, in the development of a high-strength steel sheet, it is important to achieve both these material properties and the strength.

Concretely, when the steel sheet is used to manufacture a part having a complex shape, for example, the following workings are performed. The steel sheet is subjected to shearing or punching, and is subjected to blanking or hole making, and then is subjected to press forming based on stretch-flanging and burring mainly or bulging. The steel sheet to be subjected to such workings is required to have good stretch flangeability and ductility.

In Patent Reference 1, there is described a high-strength hot-rolled steel sheet excellent in ductility, stretch flangeability, and material uniformity that has a steel microstructure having 95% or more of a ferrite phase by area ratio and in which an average particle diameter of Ti carbides precipitated in steel is 10 nm or less. However, in the case where a strength of 480 MPa or more is secured in the steel sheet disclosed in Patent Reference 1, which has 95% or more of a soft ferrite phase, it is impossible to obtain sufficient ductility.

Patent Reference 2 discloses a high-strength hot-rolled steel sheet excellent in stretch flangeability and fatigue property that contains Ce oxides, La oxides, Ti oxides, and $Al_2O_3$ inclusions. Further, Patent Reference 2 describes, a high-strength hot-rolled steel sheet in which an area ratio of a bainitic•ferrite phase is 8.0 to 100%. Further, Patent Reference 3 discloses a high-strength hot-rolled steel sheet having reduced strength variation and having excellent ductility and hole expandability in which the total area ratio of a ferrite phase and a bainite phase and the absolute value of a difference in Vickers hardness between a ferrite phase and a second phase are defined.

In Patent References 4 to 7, there is proposed a technique to improve cracking and fatigue property of a punched portion in a steel sheet to which carbide-forming elements such as Ti, Nb, and V are added. In Patent References 8 to 10, there is proposed a technique to improve cracking and a fatigue property of a punched portion by utilizing B in a steel sheet to which carbide-forming elements such as Ti, Nb, and V are added. Patent Reference 11 describes a high-strength hot-rolled steel sheet excellent in elongation property, stretch flange property, and fatigue property that has a structure mainly composed of ferrite and bainite and in which grain sizes and fractions of precipitates in ferrite and the shape of bainite are controlled. In Patent Reference 12, there is proposed a technique to improve surface defects and productivity in a continuous casting step in a steel sheet to which carbide-forming elements such as Ti, Nb, and V are added.

When a conventional high-strength steel sheet is formed by pressing in cold working, cracking sometimes occurs from an edge of a portion to be subjected to stretch flange forming during forming. This is conceivable because work hardening advances only in the edge portion due to the strain introduced into a punched end face at the time of blanking.

As an evaluation method, of a stretch flangeability test of the steel sheet, a hole expansion test has been used. However, in the hole expansion test, a test piece leads to a fracture in a state where a strain distribution in a circumferential direction little exists. In contrast to this, when the steel sheet is worked into a part shape actually, a strain distribution exists. The strain distribution, affects a fracture limit of the part. Thereby, it is estimated that even in a high-strength steel sheet that exhibits sufficient stretch flangeability in the hole expansion test, performing cold pressing sometimes causes cracking.

Patent References 1 to 3 disclose a technique to improve material properties by defining structures. However, it is unclear whether sufficient stretch flangeability can be secured even in the case where the strain distribution is considered in the steel sheets described in Patent References 1 to 3. Further, the conventional high-strength steel sheets are not the one that has excellent stretch flangeability and has a base metal and a punched portion each having a good fatigue property.

CITATION LIST

Patent Literature

Patent Reference 1: International Publication Pamphlet No. WO2013/161090

Patent Reference 2: Japanese Laid-open Patent Publication No. 2005-256115

Patent Reference 3: Japanese Laid-open Patent Publication No. 2011-140671

Patent Reference 4: Japanese Laid-open Patent Publication No. 2002-161340

Patent Reference 5: Japanese Laid-open Patent Publication No. 2002-317246

Patent Reference 6: Japanese Laid-open Patent Publication No. 2003-342684

Patent Reference 7: Japanese Laid-open Patent Publication No. 2004-250749

Patent Reference 8: Japanese Laid-open Patent Publication No. 2004-315857

Patent Reference 9: Japanese Laid-open Patent Publication NO. 2005-298924

Patent Reference 10: Japanese Laid-open Patent Publication No, 2008-266726

Patent Reference 11: Japanese Laid-open Patent Publication No. 2007-9322

Patent Reference: 12: Japanese Laid-open Patent Publication No. 2007-138238

SUMMARY OF INVENTION

Technical Problem

An object of the present invention is to provide a steel sheet and a plated steel sheet that are high in strength, have excellent stretch flangeability, and have a base metal and, a punched portion each having a good fatigue property.

Solution to Problem

According to the conventional findings, the improvement of the stretch flangeability (hole expansibility) in the high-strength steel sheet has been performed by inclusion control, homogenization of structure, unification of structure, and/or reduction in hardness difference between structures, as described in Patent References 1 to 3. In other words, conventionally, the improvement in the stretch flangeability has been achieved by controlling the structure to be observed by an optical microscope.

However, it is difficult to improve the stretch flangeability under the presence of the strain distribution even when only the structure to be observed by an optical microscope is controlled. Thus, the present inventors made an intensive study by focusing on an intragranular misorientation of each crystal grain. As a result, they found out that it is possible to greatly improve the stretch flangeability by controlling the proportion of crystal grains each having a misorientation in a crystal grain of 5 to 14° to all crystal grains to 20 to 100%.

Further, the present inventors found out that it is possible to obtain a good fatigue property in a base metal and a punched portion and prevent damage accompanying irregularities in a punched end face by setting an average aspect ratio of crystal grains and the density of the total of Ti-based carbides and Nb-based carbides each having a grain size of 20 nm or more on ferrite grain boundaries to fall within specific ranges.

The present invention was completed as a result that the present inventors conducted intensive studies repeatedly based on the new findings relating to the above-described proportion of the crystal grains each having a misorientation in a crystal grain of 5 to 14° to all the crystal grains and the new findings relating to the average aspect ratio of crystal grains and the density of the total of Ti-based carbides and Nb-based carbides each having a grain size of 20 nm or more on ferrite grain boundaries.

The gist of the present invention is as follows.

A steel sheet, includes:

a chemical composition represented by, in mass %,

C: 0.008 to 0.150%,

Si: 0.01 to 1.70%,

Mn: 0.60 to 2.50%,

Al: 0.010 to 0.60%,

Ti: 0 to 0.200%,

Nb: 0 to 0.200%,

Ti+Nb: 0.015 to 0.200%,

Cr: 0 to 1.0%,

B: 0 to 0.10%,

Mo: 0 to 1.0%,

Cu: 0 to 2.0%,

Ni: 0 to 2.0%,

Mg: 0 to 0.05%,

REM: 0 to 0.05%,

Ca: 0 to 0.05%,

Zr: 0 to 0.05%,

P: 0.05% or less,

S: 0.0200% or less,

N: 0.0060% or less, and balance: Fe and impurities; and a structure represented by, by area ratio, ferrite: 30 to 95%, and bainite: 5 to 70%, in which when a region that is surrounded by a grain boundary having a misorientation of 15° or more and has a circle-equivalent diameter of 0.3 μm or more is defined as a crystal grain, the proportion of crystal grains each having an intragranular misorientation of 5 to 14° to all crystal grains is 20 to 100% by area ratio, an average aspect ratio of ellipses equivalent to the crystal grains is 5 or less, and an average distribution density of the total of Ti-based carbides and Nb-based carbides each having a grain size of 20 rumor more on ferrite grain boundaries is 10 carbides/μm or less.

(2)

The steel sheet according to (1), in which a tensile strength is 480 MPa or more, the product of the tensile strength and a limit form height in a saddle-type stretch-flange test is 19500 mm·MPa or more, and a percent brittle fracture of a punched fracture surface is less than 20%.

(3)

The steel sheet according to (1) or (2), in which the chemical composition contains, in mass %, one type or more selected from the group consisting of Cr: 0.05 to 1.0%, and B: 0.0005 to 0.10%.

(4)

The steel sheet according to any one of (1) to (3), in which the chemical composition contains, in mass %, one type or more selected from the group consisting of Mo: 0.01 to 1.0%, Cu: 0.01 to 2.0%, and Ni: 0.01% to 2.0%.

(5)

The steel sheet according to any one of (1) to (4), in which the chemical composition contains, in mass %, one type or more selected from the group consisting of Ca: 0.0001 to 0.05%, Mg: 0.0001 to 0.05%, Zr: 0.0001 to 0.05%, and REM: 0.0001 to 0.05%.

(6)

A plated steel sheet, in which a plating layer is formed on a surface of the steel sheet according to any one of (1) to (5).

(7)

The plated steel sheet according to (6), in which the plating layer is a hot-dip galvanizing layer.

(8)

The plated steel sheet according to (6), in which the plating layer is an alloyed hot-dip galvanizing layer.

Advantageous Effects of Invention

According to the present invention, it is possible to provide a steel sheet that is high in strength, has excellent stretch flangeability, and has a base metal and a punched portion each having a good fatigue property. The steel sheet of the present invention is applicable to a member required to have strict stretch flangeability and have a fatigue property of a base metal and a punched portion while having high strength, and can prevent damage accompanying irregularities in a punched end face even when punching is performed under strict working conditions using abrasive shears or punch with a strict clearance.

DESCRIPTION OF EMBODIMENTS

Figure 1A:
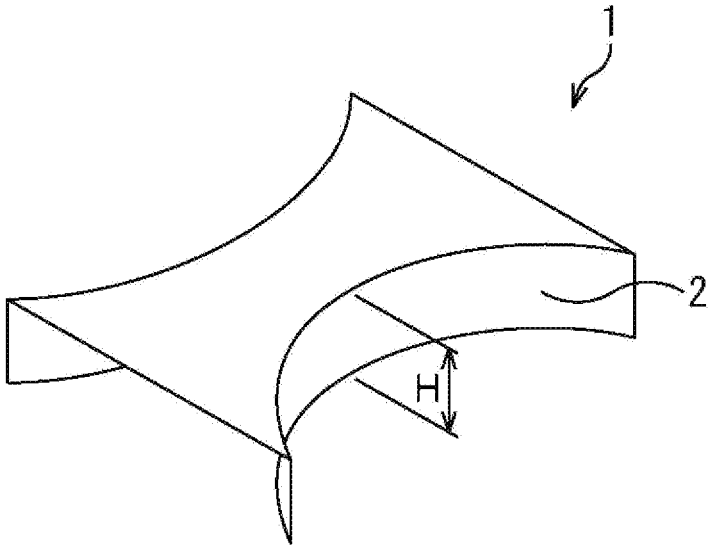
FIG. 1A is a perspective view illustrating a saddle-type formed product to be used for a saddle-type stretch-flange test method.

Hereinafter, there will be explained embodiments of the present invention.

[Chemical Composition]

First, there will be explained a chemical composition of a steel sheet according to the embodiment of the present invention. In the following explanation, "%" that is a unit of the content of each element contained in the steel sheet means "mass %" unless otherwise stated. The steel sheet according to this embodiment has a chemical composition represented by C: 0.008 to 0.150%, Si: 0.01 to 1.70%, Mn: 0.60 to 2.50%, Al: 0.010 to 0.60%, Ti: 0 to 0.200%, Nb: 0 to 0.200%, Ti 0.015 to 0.200%, Cr: 0 to 1.0%, B: 0 to 0.10%, Mo: 0 to 1.0%, Cu: 0 to 2.0%, Ni: 0 to 2.0%, Mg: 0 to 0.05%, rare earth metal (REM): 0 to 0.05%, Ca: 0 to 0.05%, Zr: 0 to 0.05%, P: 0.05% or less, S: 0.0200% or less, N: 0.0060% or less, and balance: Fe and impurities. Examples of the impurities include one contained in raw materials such as ore and scrap, and one contained during a manufacturing process.

"C: 0.008 to 0.150%"

C bonds to Nb, Ti, and so on to form precipitates in the steel sheet and contributes to an improvement in strength of steel by precipitation strengthening. When the C content is less than 0.008%, it is impossible to sufficiently obtain this effect. Therefore, the C content is set to 0.008% or more. The C content is preferably set to 0.010% or more and more preferably set to 0.018% or more. On the other hand, when the C content is greater than 0.150%, an orientation spread in bainite is likely to increase and the proportion of crystal grains each having an intragranular misorientation of 5 to 14° becomes short. Further, when the C content is greater than 0.150%, cementite harmful to the stretch flangeability increases and the stretch flangeability deteriorates. Therefore, the C content is set to 0.150% or less. The C content is preferably set to 0.100% or less and more preferably set to 0.090% or less.

"Si: 0.01 to 1.70%"

Si functions as a deoxidizer for molten steel. When the Si content is less than 0.01%, it is impossible to sufficiently obtain this effect. Therefore, the Si content is set to 0.01% or more. The Si content is preferably set to 0.02% or more and more preferably set to 0.03% or more. On the other hand, when the Si content is greater than 1.70%, the stretch flangeability deteriorates or surface flaws occur. Further, when the Si content is greater than 1.70%, the transformation point rises too much, to then requite an increase in rolling temperature. In this case, recrystallization during hot rolling is promoted significantly and the proportion of the crystal grains each having an intragranular misorientation of 5 to 14° becomes short. Further, when the Si content is greater than 1.70%, surface flaws are likely to occur when a plating layer is formed on the surface of the steel sheet. Therefore, the Si content is set to 1.70% or less. The Si content is preferably set to 1.60% or less, more preferably set to 1.5.0% or less, and further preferably set to 1.40% or less.

"Mn: 0.60 to 2.50%"

Mn contributes to the strength improvement of the steel by solid-solution strengthening Ox improving hardenability of the steel. When the Mn content is less than 0.60%, it is impossible to sufficiently obtain this effect. Therefore, the Mn content is set to 0.60% or more. The Mn content is preferably set to 0.70% or more and more, preferably set to 0.80% or more. On the other hand, when the Mn content is greater than 2.50%, the hardenability becomes excessive and the degree of orientation spread in bainite increases. As a result, the proportion of the crystal grains each having an intragranular misorientation of 5 to 14° becomes short and the stretch flangeability deteriorates. Therefore, the Mn content is set to 2.50% or less. The Mn content is preferably set to 2.30% or less and more preferably set to 2.10% or less.

"Al: 0.010 to 0.60%"

Al is effective as a deoxidizer for molten steel. When the Al content is less than 0.010%, it is impossible to sufficiently obtain this effect. Therefore, the Al content is set to 0.010% or more. The Al content is preferably set to 0.020% or more and more preferably set to 0.030% or more. On the other hand, when the Al content is greater than 0.60%, weldability, toughness, and so on deteriorate. Therefore, the Al content is set to 0.60% or less. The Al content is preferably set to 0.50% or less and more preferably set to 0.40% or less.

"Ti: 0 to 0.200%, Nb: 0 to 0.200%, Ti+Nb: 0.015 to 0.200%"

Ti and Nb finely precipitate in the steel as carbides (TiC, NbC) and improve the strength of the steel by precipitation strengthening. Further, Ti and Nb form carbides to thereby fix C, resulting in that generation of cementite harmful to the stretch flangeability is suppressed. Further, Ti and Nb can significantly improve the proportion of the crystal grains each having, an intragranular misorientation of 5 to 14° and improve the stretch flangeability while improving the strength of the steel. When the total content of Ti and Nb is less than 0.015%, the proportion of the crystal grains each having an intragranular misorientation of 5 to 14° becomes short and the stretch flangeability deteriorates. Therefore, the total content of Ti and Nb is set to 0.015% or more. The total content of Ti and Nb is preferably set to 0.018% or more. Further, the Ti content is preferably set to 0.015% or more, more preferably set to 0.020% or more, and further preferably set to 0.025% or more. Further, the Nb content is preferably set to 0.015% or more, more preferably set to 0.020% or more, and further preferably set to 0.025% or more. On the other hand, when the total content of Ti and Nb is greater than 0.200%, the ductility and the workability deteriorate and the frequency of cracking during rolling increases. Therefore, the total content of Ti and Nb is set to 0.200% or less. The total content of Ti and Nb is preferably set to 0.1500% or less. Further, when the Ti content is greater than 0.200%, the ductility deteriorates. Therefore, the Ti content is set to 0.200% or less. The Ti content is preferably set to 0.180% or less and more preferably set to 0.160% or less. Further, when the Nb content is greater than 0.200%, the ductility deteriorates. Therefore, the Nb content is set to 0.200% or less. The Nb content is preferably set to 0.180% or less and, more preferably set to 0.160% or less.

"P: 0.05% or Less"

P is an impurity. P deteriorates toughness, ductility, weldability, and so on, and thus a lower P content is more preferable. When the P content is greater than 0.05%, the deterioration in stretch flangeability is prominent. Therefore, the P content is set to 0.05% or less. The P content is preferably set to 0.03% or less and more preferably set to 0.02% or less. The lower limit of the P content is not determined in particular, but its excessive reduction is not desirable from the viewpoint of manufacturing cost. Therefore, the P content may be set to 0.005% or more.

"S: 0.0200% or Less"

S is an impurity. S causes cracking at the time of hot rolling, and further forms A-based inclusions that deteriorate the stretch flangeability. Thus, a lower S content is more preferable. When the S content is greater than 0.0200%, the deterioration in stretch flangeability is prominent. Therefore, the S content is set to 0.0200% or less. The S content is preferably set to 0.0150% or less and more preferably set to 0.0060% or less. The lower limit of the S content is not determined in particular, but its excessive reduction is not desirable from the viewpoint of manufacturing cost. Therefore, the S content may be set to 0.0010% or more.

"N: 0.0060% or Less"

N is an impurity. N forms precipitates with Ti and Nb preferentially over C and reduces Ti and Nb effective for fixation of C. Thus, a lower N content is more preferable. When the N content is greater than 0.0060%, the deterioration in stretch flangeability is prominent. Therefore, the N content is set to 0.0060% or less. The N content is preferably set to 0.0050% or less. The lower limit of the N content is not determined in particular, but its excessive reduction is not desirable from the viewpoint of manufacturing cost. Therefore, the N content may be set to 0.0010% or more.

Cr, B, Mo, Cu, Ni, Mg, REM, Ca, and Zr are not essential elements, but are arbitrary elements that may be contained as needed in the steel sheet up to predetermined amounts.

"Cr: 0 to 1.0%"

Cr contributes to the strength improvement of the steel. Desired purposes are achieved without Cr being contained, but in order to sufficiently obtain this effect, the Cr content, is preferably sat to 0.05% or more. On the other hand, when the Cr content is greater than 1.0%, the above-described effect is saturated and economic efficiency decreases. Therefore, the Cr content is set to 1.0% or less.

"B: 0 to 0.10%"

B increases the hardenability and increases a structural fraction of a low-temperature transformation generating phase being a hard phase. Desired purposes are achieved without B being contained, but in order to sufficiently obtain this effect, the B content is preferably set to 0.0005% or more. On the other hand, when the B content is greater than 0.10%, the above-described effect is saturated and economic efficiency decreases. Therefore, the B content is set to 0.10% or less.

"Mo: 0 to 1.0%"

Mo improves the hardenability, and at the same time, has an effect of increasing the strength by forming carbides. Desired purposes are achieved without Mo being contained, but in order to sufficiently obtain this effect, the Mo, content is preferably set to 0.01% or more. On the other hand, when the Mo content is greater than 1.0%, the ductility and the weldability sometimes decrease. Therefore, the Mo content is set to 1.0% or less.

"Cu: 0 to 2.0%"

Cu increases the strength of the steel sheet, and at the same time, improves corrosion resistance and removability of scales. Desired purposes are achieved without Cu being contained, but in order to sufficiently obtain this effect, the Cu content is preferably set to 0.01% or more and more preferably set to 0.04% or more. On the other hand, when the Cu content is greater than 2.0%, surface flaws sometimes occur. Therefore, the Cu content is set to 2.0% or less and preferably set to 1.0% or less.

"Ni: 0 to 2.0%"

Ni increases the strength of the steel sheet, and at the same time, improves the toughness. Desired purposes are achieved without Ni being contained, but in Order to sufficiently obtain this effect, the Ni content is preferably set to 0.01% or more. On the other hand, when the Ni content is greater than 2.0%, the ductility decreases. Therefore, the Ni content is set to 2.0% or less.

"Mg: 0 to 0.05%, REM: 0 to 0.05%, Ca: 0 to 0.05%, Zr: 0 to 0.05%"

Ca, Mg, Zr, and REM all improve toughness by controlling shapes of sulfides and oxides. Desired purposes are achieved without Ca, Mg, Zr, and REM being contained, but in order to sufficiently obtain this effect, the content of one type or more selected from the group consisting of Ca, Mg, Zr, and REM is preferably set to 0.0001% or more and more preferably set to 0.0005% or more. On the other hand, when the content of Ca, Mg, Zr, or REM is greater than 0.05%, the stretch flangeability deteriorates. Therefore, the content of each of Ca, Mg, Zr, and REM is set to 0.05% or less.

"Metal Microstructure"

Next, there will be explained a structure (metal microstructure) of the steel sheet according to the embodiment of the present invention. In the following explanation, "%" that is a unit of the proportion (area ratio) of each structure means "area %" unless otherwise stated. The steel sheet according to this embodiment has a structure represented by ferrite: 30 to 95% and bainite: 5 to 70%.

"Ferrite: 30 to 95%"

When the area ratio of the ferrite is less than 30%, it is impossible to obtain a sufficient fatigue property. Therefore, the area ratio of the ferrite is set to 30% or more, preferably set to 40% or more, more preferably set to 50% or more, and further preferably set to 60% or more. On the other hand, when the area ratio of the ferrite is greater than 95%, the stretch flangeability deteriorates or it becomes difficult, to obtain sufficient strength. Therefore, the area ratio of the ferrite is set to 95% or less.

"Bainite: 5 to 70%"

When the area ratio of the bainite less than 5%, the stretch flangeability deteriorates. Therefore, the area ratio of the bainite is set to 5% or more. On the other hand, when the area ratio of the bainite is greater than 70%, the ductility deteriorates. Therefore, the area ratio of the bainite is set to 70% or less, preferably set to 60% or less, more preferably set to 50% or less, and further preferably set to 40% or less.

The structure of the steel sheet may contain pearlite or martensite or both of these. The pearlite is good in fatigue property and stretch flangeability similarly to the bainite. When pearlite and bainite are compared, the bainite is better in fatigue property of the punched portion. The area ratio of the pearlite is preferably set to 0 to 15%. When the area ratio of the pearlite is in this range, it is possible to obtain a steel sheet having a punched portion with a better fatigue property. The martensite adversely affects the stretch flangeability, and thus the area ratio of the martensite is preferably set to 10% or less. The area ratio of the structure other than the ferrite, the bainite, the pearlite, and the martensite is preferably set to 10% or less, more preferably set to 5% or less, and further preferably set to 3% or less.

The proportion (area ratio) of each structure can be obtained by the following method. First, a sample collected from the steel sheet is etched by nital. After the etching, a structure photograph obtained at a ¼ depth position of the sheet thickness in a visual field of 300 μm×300 μm is subjected to an image analysis by using an optical microscope. By this image analysis, the area ratio of ferrite, the area ratio of pearlite, and the total area ratio of bainite and martensite are obtained. Then, a sample etched by LePera is used, and a structure photograph obtained, at a ¼ depth position of the sheet thickness in a visual field of 300 μm×300 μm is subjected to an image analysis by using an optical microscope. By this image analysis, the total area ratio, of retained austenite and martensite is obtained. Further, a Sample, obtained by grinding the surface to a depth of ¼ of the sheet thickness from a direction normal to a rolled surface is used, and the volume fraction of retained austenite is obtained through an X-ray diffraction measurement. The volume fraction of the retained austenite is equivalent to the area ratio, and thus is set as the area ratio of the retained austenite. Then, the area ratio of martensite is obtained by subtracting the area ratio of the retained austenite from the total area ratio of the retained austenite and the martensite, and the area ratio of bainite is obtained by subtracting the area ratio of the martensite from the total area ratio of the bainite and the martensite. In this manner, it is possible, to obtain the area ratio of each of ferrite, bainite, martensite, retained austenite, and pearlite.

In the steel sheet according to this embodiment, in the case where a region surrounded by a grain boundary having a misorientation of 15° or more and having a circle-equivalent diameter of 0.3 μm or more is defined as a crystal grain, the proportion of crystal grains each having an intragranular misorientation of 5 to 14° to all crystal grains is 20 to 100% by area ratio. The intragranular misorientation is obtained by using an electron back scattering diffraction (EBSD) method that is often used for a crystal orientation analysis. The intragranular misorientation is a value in the case where a boundary having a misorientation of 15° or more is set as a grain boundary in a structure and a region surrounded by this grain boundary is defined as a crystal grain.

The crystal grains each having an intragranular misorientation of 5 to 14° axe effective for obtaining a steel sheet excellent in the balance between strength and workability. The proportion of the crystal grains each having an intragranular misorientation of 5 to 14° is increased, thereby making it possible to improve the stretch flangeability while maintaining desired strength of the steel sheet. When the proportion of the crystal grains each having an intragranular misorientation of 5 to 14° to all the crystal grains is 20% or more by area ratio, desired strength and stretch flangeability of the steel sheet can be obtained. It does not matter that the proportion of the crystal grains each having an intragranular misorientation of 5 to 14° is high, and thus its upper limit is 100%.

A cumulative strain at the final three stages of finish rolling is controlled as will be described later, and thereby crystal misorientation occurs in grains of ferrite and bainite. The reason for this is considered as follows. By controlling the cumulative strain, dislocation in austenite increases, dislocation walls are made in an austenite grain at a high density, and some cell blocks are formed. These cell blocks have different crystal orientations. It is conceivable that austenite that has a high dislocation density and contains the cell blocks having different crystal orientations is transformed, and thereby, ferrite and bainite also include crystal misorientations even in the same grain and the dislocation density also increases. Thus, the intragranular crystal misorientation is conceived to correlate with the dislocation density contained in the crystal grain. Generally, the increase in the dislocation density in a grain brings about an improvement in strength, but lowers the workability. However, the crystal grains each having an intragranular misorientation controlled to 5 to 14° make it possible to improve, the strength without lowering the workability. Therefore, in the steel sheet according to this embodiment, the proportion of the crystal grains each having an intragranular misorientation of 5 to 14° is set to 20% or more. The crystal grains each having an intragranular misorientation of less than 5° are excellent in workability, but have difficulty in increasing the strength. The crystal grains each having an intragranular misorientation of greater than 14° do not contribute to the improvement in stretch flangeability because they are different in deformability among the crystal grains.

The proportion of the crystal grains each having an intragranular misorientation of 5 to 14° can be measured by the following method. First, at a ¼ depth position of a sheet thickness t from the surface of the steel sheet (¼ t portion) in a cross section vertical to a rolling direction, a region of 200 μm in the rolling direction and 100 μm in a direction normal to the rolled surface is subjected to an EBSD analysis at a measurement pitch of 0.2 μm to obtain crystal orientation information. Here, the EBSD analysis is performed by using an apparatus that is composed of a thermal field emission scanning electron microscope (JSM-7001F manufactured by JEOL Ltd.) and an EBSD detector (HIKARI detector manufactured by TSL Co., Ltd.), at an analysis speed of 200 to 300 points/second. Then, with respect to the obtained crystal orientation information, a region having a misorientation of 15° or more and a circle-equivalent diameter of 0.3 μm or more is defined as a crystal grain, the average intragranular misorientation of crystal grains is calculated, and the proportion of the crystal grains each having an intragranular misorientation of 5 to 14° obtained. The crystal grain defined as described above and the average intragranular misorientation can be calculated by using software "OIM Analysis (registered trademark)" attached to an EBSD analyzer.

The "intragranular misorientation" in this embodiment means "Grain Orientation Spread (GOS)" that is an orientation spread in a crystal grain. The value of the intragranular misorientation is obtained as an average value of misorientations between the reference crystal orientation and all measurement points in the same crystal grain as described in "Misorientation Analysis of Plastic Deformation of Stainless Steel by EBSD and X-ray Diffraction Methods," KIMURA Hidehiko, et al., Transactions of the Japan Society of Mechanical Engineers (series A), Vol. 71, No. 712, 2005, p. 1722-1728. In this embodiment, the reference crystal orientation is an orientation obtained by averaging all the measurement points in the same crystal grain. The value of GOS can be calculated by using software "OIM Analysis (registered trademark) Version 7.0.1" attached to the EBSD analyzer.

In the steel sheet according to this embodiment, the area ratios of the respective structures observed by an optical microscope such as ferrite and bainite and the proportion of the crystal grains each having an intragranular misorientation of 5 to 14° have no direct relation. In other words, for example, even if there are steel sheets having the same area ratio of ferrite and the same area ratio of bainite, they are not necessarily the same in the proportion of the crystal grains each having an intragranular Misorientation of 5 to 14°. Accordingly, it is impossible to obtain properties equivalent to those of the steel sheet according to this embodiment only by controlling the area ratio of ferrite and the area ratio of bainite.

The average aspect ratio of ellipses equivalent to crystal grains in the structure correlates with cracking of the punched end face or occurrence behavior of irregularities. When the average aspect ratio of ellipses equivalent to the crystal grains exceeds 5, cracking becomes prominent and a fatigue crack starting from the punched portion is likely to occur. Thus, the average aspect ratio of ellipses equivalent to the crystal grains is set to 5 or less. The average aspect ratio is preferably set to 3.5 or less. This makes it possible to prevent occurrence of cracking even under stricter punching. The lower limit of the average aspect ratio of ellipses equivalent to the crystal grains is not limited in particular, but 1 to be equivalent to a circle is the substantial lower limit.

Here, the average aspect ratio is a value obtained by observing a structure of an L cross section (cross section parallel to the rolling direction), measuring (ellipse major axis length)/(ellipse minor axis length) of 50 or more crystal grains, and averaging measured values. Incidentally, the crystal grain here is a grain surrounded by a high-angle tilt grain boundary with a grain boundary tilt angle of 10° or more.

When fine Ti-based carbides or Nb-based carbides exist on ferrite grain boundaries in the structure and the crystal grains are flat, the percent brittle fracture of a punched fracture surface increases and the fatigue property worsens. According to the observation conducted by the present inventors, it is conceivable that Ti-based carbides and Nb-based carbides each having a grain size of 20 nm or more on ferrite grain boundaries are likely to cause occurrence of voids when strain concentrates, resulting in a cause of grain boundary fracture. When the Ti-based carbides and the Nb-based carbides each having 20 nm or more on ferrite grain boundaries exist in excess of 10 carbides per 1 μm of the grain-boundary length in terms of the average distribution density of the total, the percent brittle fracture increases to cause a decrease in fatigue property of a member. Therefore, the average distribution density of the total of Ti-based carbides and Nb-based carbides each having a grain size of 20 nm or more on ferrite grain boundaries is set to 10 carbides/μm or less and preferably set to 6 carbides/μm or less. A lower average distribution density of the total of Ti-based carbides, and Nb-based carbides each having a grain size of 20 nm or more on ferrite grain boundaries is more preferable from the viewpoint of suppression of brittle fracture surfaces. When the average distribution density of the total of Ti-based carbides and Nb-based carbides each having a grain size of 20 nm or more on ferrite grain boundaries is 0.1 carbides/μm or less, the brittle fracture surface hardly occurs. Incidentally, the average distribution density of the total of Ti-based carbides and Nb-based carbides on ferrite grain boundaries is calculated by using the result obtained by observing a cut sample of an L cross section (cross section parallel to the rolling direction) by using a scanning electron microscope (SEM).

The fracture surface form at the punched fracture surface correlates with irregularities of the punched fracture surface or behavior of occurrence of microcracks, and affects the fatigue property of a member having a punched portion. When the percent brittle fracture in the fracture surface is 20% or more, the irregularities of the fracture surface are large and microcracks are likely to occur, resulting in that the occurrence of fatigue, cracks in the punched portion is promoted. According to this embodiment, the percent brittle fracture of less than 20% is obtained and the percent brittle fracture of 10% or less is obtained in some cases. The percent brittle fracture in the fracture surface is a measured value obtained by punching a sample steel sheet by shears or a punch under a condition of a clearance being 10 to 15% of the sheet thickness and observing a formed fracture surface.

A texture of the steel sheet affects the fatigue property of the punched portion through the effect on occurrence of cracking in the punched fracture surface or a residual stress distribution. When X-ray random intensity ratios of the {112}<110> orientation and the {332}<113> orientation of the sheet surface in the sheet thickness center portion each exceed 5, cracking in the fracture surface of the punched portion occurs in some cases. Thus, the X-ray random intensity ratio of each of the above-described orientations is preferably set to 5 or less and more preferably set to 4 or less. When the X-ray random intensity ratio of each of the above-described orientations is 4 or less, cracking does not easily occur even when punching is performed by an abrasive punch to be used in mass production. As for the X-ray random intensity ratio of each of the above-described orientations, 1 being random completely is the substantial lower limit.

Figure 1B:
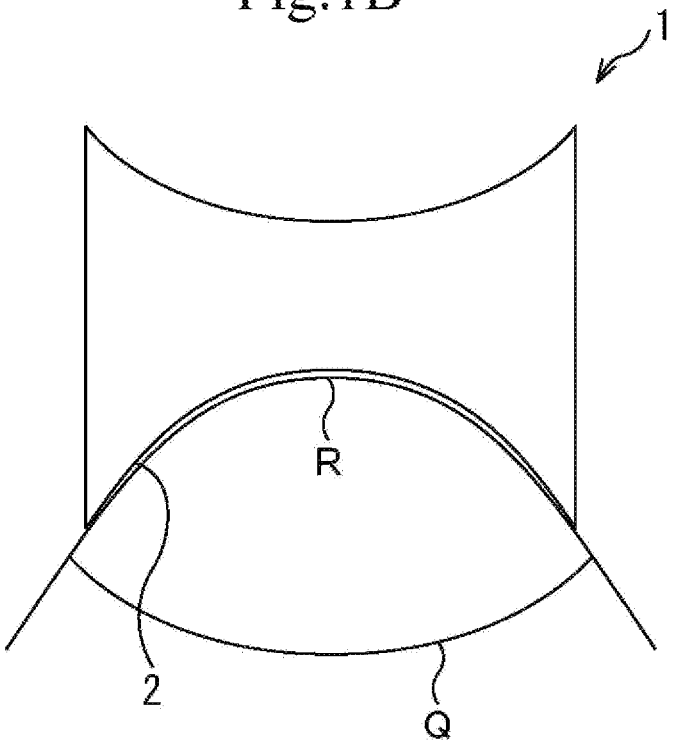
FIG. 1B is a plan view illustrating the saddle-type formed product to be used for the saddle-type stretch-flange test method.

In this embodiment, the stretch flangeability is evaluated by a saddle-type stretch-flange test method using a saddle-type formed product. FIG. 1A and FIG. 1B are views each illustrating a saddle-type formed product to be used for a saddle-type stretch-flange test method in this embodiment, FIG. 1A is a perspective view, and FIG. 1B is a plan view. In the saddle-type stretch-flange test method, concretely, a saddle-type formed product 1 simulating the stretch flange shape formed of a linear portion and an arc portion as illustrated in FIG. 1A and FIG. 1B is pressed, and the stretch flangeability is evaluated by using a limit form height at that time. In the saddle-type stretch-flange test method in this embodiment, a limit form height H (mm) obtained when a clearance, at the time of punching a corner portion 2 is set to 11% is measured by using the saddle-type formed product 1 in which a radius of curvature R of the corner portion 2 is set to 50 to 60 mm and an opening angle θ of the corner portion 2 is set to 120°. Here, the clearance indicates the ratio of a gap between a punching die and a punch and the thickness of the test piece. Actually, the clearance is determined by the combination of a punching tool and the sheet thickness, to thus mean that 11% satisfies a range of 10.5 to 11.5%. As for determination of the limit form height H, whether or not a crack having a length of ⅓ or more of the sheet thickness exists is visually observed after forming, and then a limit form height with no existence of cracks is determined as the limit form height.

In a conventional hole expansion test used as a test method coping with the stretch flangeability, the sheet leads to a fracture with little or no strain distributed in a circumferential direction. Therefore, the strain and the stress gradient around a fractured portion differ from those at an actual stretch flange forming time. Further, in the hole expansion test, evaluation is made at the point in time when a fracture occurs penetrating the sheet thickness, or the like, resulting in that the evaluation reflecting the original stretch flange forming is not made. On the other hand, the saddle-type stretch-flange test used in this embodiment, the stretch flangeability considering the strain distribution can be evaluated, and thus the evaluation reflecting the original stretch flange forming can be made.

According to the steel sheet according to this embodiment, a tensile strength of 480 MPa or more can be obtained. That is, an excellent tensile strength can be obtained. The upper limit of the tensile strength is not limited in particular. However, in a component range in this embodiment, the upper limit of the practical tensile strength is about 1180 MPa. The tensile, strength can be measured by fabricating a No. 5 test piece described in JIS-Z2201 and performing a tensile test according to a test method described in JIS-Z2241.

According to the steel sheet according to this embodiment, the product of the tensile strength and the limit form height in the saddle-type stretch-flange test, which is 19500 mm·MPa or more, can be obtained. That is, excellent stretch flangeability can be obtained. The upper limit of this product is not limited in particular. However, in a component range in this embodiment, the upper limit of this practical product is about 25000 mm·MPa.

According to the steel sheet according to this embodiment, a percent brittle fracture of less than 20% and a fatigue limit ratio of 0.4 or more can be obtained. That is, it is possible to obtain an excellent fatigue property in the base metal and the punched portion.

Next, there will be explained a method of manufacturing the steel sheet according to the embodiment of the present invention. In this method, hot rolling, air cooling, first cooling, and second cooling are performed in this order.

"Hot Rolling"

The hot rolling includes rough rolling and finish rolling. In the hot rolling, a slab (steel billet) having the above-described chemical composition is heated to be subjected to rough rolling. A slab heating temperature is set to SRT min° C. expressed, by Expression (1) below or more and 1260° C. or less.

$$\text{SRT min}=[7000/(2.75-\log([\text{Ti}]\times[\text{C}]))-273)+10000/\{4.29-\log([\text{Nb}]\times[\text{C}])\}-273)]/2 \quad (1)$$

Here, [Ti], [Nb], and [C] in Expression (1) represent the contents of Ti, Nb, and C in mass %.

When the slab heating temperature is less than SRT min° C., Ti and/or Nb are/is not sufficiently brought into solution. When Ti and/or Nb are/is not brought into solution at the time of slab heating, it becomes difficult to make Ti and/or Nb finely precipitate as carbides (Tic, NbC) and improve the strength of the steel by precipitation strengthening. Further, when the slab heating temperature is less than SRT min° C., it becomes difficult to fix C by formation of the carbides (TiC, NbC) to suppress generation of cementite harmful to a burring property. Further, when the slab heating temperature is less than SRT min° C. the proportion of the crystal grains each having an intragranular crystal misorientation of 5 to 14° is likely to be short. Therefore, the slab heating temperature is set to SRT min° C. or more. On the other hand, when the slab heating temperature is greater than 1260° C., the yield decreases due to scale-off. Therefore, the slab heating temperature is set to 1260° C. or less.

By the rough rolling, a rough bar is obtained. When a finishing temperature of the rough rolling is less than 1000°, crystal grains after finish hot rolling become flat and cracking occurs in a fracture surface of the punched portion in some cases. Therefore, the finishing temperature of the rough rolling is set to 1000° C. or more.

After the rough rolling, heating may be performed by the time the finish rolling is completed. By performing the heating, the temperature in the width direction and the temperature in the longitudinal direction of the rough bar become uniform and the variations in material in a coil being a product decrease. A heating method in the heating is not limited in particular. It may be performed by a method of furnace heating, induction heating, energization heating, high-frequency heating or the like, for example.

After the rough rolling, descaling may be performed by the time the finish rolling is completed. By the descaling, surface toughness, becomes small and the fatigue property improves in some cases. A method of the descaling is not limited in particular. It can be performed by a high-pressure stream of water, for example.

A time period between finish of the rough rolling and start of the finish rolling affects the fracture surface form of the punched fracture surface through recrystallization behavior of austenite during rolling. When the time period between finish of the rough rolling and start of the finish rolling is less than 45 seconds, the percent brittle fracture of the punched end face sometimes increases. Therefore, the time period between finish of the rough rolling and start of the finish rolling is set to 45 seconds or more. This time period is set to 45 seconds or more, and thereby the recrystallization of austenite is further promoted, the crystal grains can be made more spherical, and the fatigue property of the punched portion further improves.

By the finish rolling, a hot-rolled steel sheet is obtained. The cumulative strain at the final three stages (final three passes) in the finish rolling is set to 0.5 to 0.6 in order to set the proportion of the crystal grains each having an intragranular misorientation of 5 to 14° to 20% or more, and then later-described cooling is performed. This is due to the following reason. The crystal grains each having an intragranular misorientation of 5 to 14° are generated by being transformed in a paraequilibrium state at relatively low temperature. Therefore, the dislocation density of austenite before transformation is limited to a certain range in the hot rolling, and at the same time, the subsequent cooling rate is limited to a certain range, thereby making it possible to control generation of the crystal grains each having an intragranular misorientation of 5 to 14°.

That is, the cumulative strain at the final three stages in the finish rolling and the subsequent cooling are controlled, thereby making it possible to control the nucleation frequency of the crystal grains each having an intragranular misorientation of 5 to 14° and the subsequent growth rate. As a result, it is possible to control the area ratio of the crystal grains each having an intragranular misorientation of 5 to 14° in a steel sheet to be obtained after cooling. More concretely, the dislocation density of the austenite introduced by the finish rolling is mainly related to the nucleation frequency and the cooling rate after the rolling is mainly related to the growth rate.

When the cumulative strain at the final three stages in the finish rolling is less than 0.5, the dislocation density of the austenite to be introduced is not sufficient and the proportion of the crystal grains each having an intragranular misorientation of 5 to 14° becomes less than 20%. Therefore, the cumulative strain at the final three stages is set to 0.5 or more. On the other hand, when the cumulative strain at the final three stages in the finish rolling exceeds 0.6, recrystallization of the austenite occurs during the hot rolling and the accumulated dislocation density at a transformation time decreases. As a result, the proportion of the crystal grains each having an intragranuler misorientation of 5 to 14° becomes less than 20%. Therefore, the cumulative strain at the final three stages is set to 0.6 or less.

The cumulative strain et the final three stages in the finish rolling (εeff.) is obtained by Expression (2) below.

$$\varepsilon eff.=\Sigma\varepsilon i(t,T) \quad (2)$$

Here, $\varepsilon i(t,T)=\varepsilon i0/\exp\{(t/\tau R)^{2/3}\}$, $\tau R=\tau 0\cdot\exp(Q/RT)$, $\tau 0=8.46\times10^{-9}$,

Q=183200 J,

R=8.314 J/K·mol,

εi0 represents a logarithmic strain at reduction, time, t represents a cumulative time period till immediately before the cooling in the pass, and T represents a rolling temperature in the pass.

When a finishing temperature of the rolling is set to less than $Ar_3$° C., the dislocation density of the austenite before transformation increases excessively, to thus make it difficult to set the crystal grains each having an intragranular misorientation of 5 to 14° to 20% or more. Therefore, the finishing temperature of the finish rolling is set to $Ar_3$° C. or more.

The finish rolling is preferably performed by using a tandem rolling mill in which a plurality of rolling mills are linearly arranged and that performs rolling continuously in one direction to obtain a desired thickness. Further, in the case where the finish rolling is performed using the tandem rolling mill, cooling (inter-stand cooling) is performed between the rolling mills to control the steel sheet temperature during the finish rolling to fall within a range of $Ar_3$° C. or more to $Ar_3$+150° C. or less. When the maximum temperature of the steel sheet during the finish rolling exceeds $Ar_3$+150° C., the grain size becomes too large, and thus deterioration in toughness is concerned.

The hot rolling is performed under such conditions as above, thereby making it possible to limit the dislocation density range of the austenite before transformation and obtain a desired proportion of the crystal grains each having an intragranular misorientation of 5 to 14°.

$Ar_3$ is calculated by Expression (3) below considering the effect on the transformation paint by reduction based on the chemical composition of the steel sheet.

$$Ar_3=970-325\times[C]+33\times[Si]+287\times[P]+40\times[Al]-92\times([Mn]+[Mo]+[Cu])-46\times([Cr]+[Ni]) \quad (3)$$

Here, [C], [Si], [P], [Al], [Mn], [Mo], [Cu], [Cr], and [Ni] represent the contents of C, Si, P, Al, Mn, Mo, Cu, Cr, and Ni in mass % respectively. The elements that are not contained are calculated as 0%.

"Air Cooling"

In this manufacturing method, air cooling of the hot-rolled steel sheet is performed only for a time period of greater than 2 seconds and 5 seconds or less after the finish rolling is finished. This air cooling time period affects flattening of crystal grains after transformation in relation to the recrystallization of austenite. When the air cooling time period is 2 seconds or less, the percent brittle fracture of the punched end face increases. Thus, this air cooling time period is set to greater than 2 seconds and preferably set to 2.5 seconds or more. When the air cooling time period exceeds 5 seconds, coarse TiC and/or NbC precipitate/precipitates, and thereby it becomes difficult to secure strength, and at the same time, the property of the punched end face deteriorates. Therefore, the air cooling time period is set to 5 seconds or less.

"First Cooling, Second Cooling"

After the air cooling for greater than 2 seconds and 5 seconds or less, the first cooling and the second cooling of the hot-rolled steel sheet are performed in this order. In the first cooling, the hot-rolled steel sheet is cooled down to a first temperature zone of 600 to 750° C. at a cooling rate of 10° C./s or more. In the second cooling, the hot-rolled steel sheet is cooled down to a second temperature zone of 450 to 650° C. at a cooling rate of 30° C./s or more. Between the first cooling and the second cooling, the hot-rolled steel sheet is retained in the first temperature zone for 1 to 10 seconds. After the second cooling, the hot-rolled steel sheet is preferably air-cooled.

When the cooling rate of the first cooling is less than 10° C./s, the proportion of the crystal grains each having an intragranular crystal misorientation of 5 to 14° becomes short. Further, when a cooling stop temperature of the first cooling is less than 600° C., it becomes difficult to obtain 30% or more of ferrite by area ratio, and at the same time, the proportion of the crystal grains each having an intragranular crystal misorientation of 5 to 14° becomes short. As the cooling stop temperature of the first cooling is higher, the ferrite fraction becomes higher. From the viewpoint of obtaining a high ferrite fraction, the cooling stop temperature of the first cooling is set to 600° C. or more, preferably set to 610° C. or more, more preferably set to 620° C. or more, and further preferably set to 630° C. or more. Further, when the cooling stop temperature of the first cooling is greater than 750° C., it becomes difficult to obtain 5% or more of bainite by area ratio, and at the same time, the proportion of the crystal grains each having an intragranular crystal misorientation of 5 to 14° becomes short, or the average distribution density of the Ti-based carbides and the Nb-based carbides on the ferrite grain boundaries becomes excessive.

When the retention time at 600 to 750° C. exceeds 10 seconds, cementite harmful to the burring property is likely to be generated. Further, when the retention time at 600 to 750° C. exceeds 10 seconds, it is often difficult to obtain 5% or more of bainite by area ratio, and further, the proportion of the crystal grains each having an intragranular crystal misorientation of 5 to 14° becomes short. When the retention time at 600 to 750° C. is less than 1 second, it becomes difficult to obtain 30% or more of ferrite by area ratio, and at the same time, the proportion of the crystal grains each having an intragranular crystal misorientation of 5 to 14° becomes short. As the retention time is longer, the ferrite fraction becomes higher. From the viewpoint of obtaining a high ferrite fraction, the retention time is set to 1 second or more, preferably set to 1.5 seconds or more, more preferably set to 2 seconds or more, and further preferably set to 2.5 seconds or more.

When the cooling rate of the second cooling is less than 30° C./s, cementite harmful to the burring property is likely to be generated, and at the same time, the proportion of the crystal grains each having an intragranular crystal misorientation of 5 to 14° becomes short. When a cooling stop temperature of the second cooling is less than 450° C., it becomes difficult to obtain 30% or more of ferrite by area ratio, and at the same time, the proportion of the crystal grains each having an intragranular crystal misorientation of 5 to 14° becomes short. As the cooling stop temperature of the second cooling is higher, the ferrite fraction becomes higher. From the viewpoint of obtaining a high ferrite fraction, the cooling stop temperature of the second cooling is set to 450° C. or more, more preferably set to 510° C. or more, and further preferably set to 550° C. or more. On the other hand, when the cooling stop temperature of the second cooling is greater than 650° C., it becomes difficult to obtain 5% or more of bainite by area ratio, and at the same time, the proportion of the crystal grains each having an intragranular misorientation of 5 to 14° becomes short.

The upper limit of the cooling rate in each of the first cooling and the second cooling is not limited, in particular, but may be set to 200° C./s or less in consideration of the facility capacity of a cooling facility. The area ratios of ferrite and bainite complexly depend on the conditions of the first cooling, the second cooling, and the retention between them and are not able to be controlled only by each of these conditions, but have the following tendency, for example. That is, when the cooling stop temperature of the first cooling is 610° C. or more, it is easy to set the area ratio of ferrite to 40% or more, when it is 620° C., it is easy to set the area ratio of ferrite to 50% or more, and when it is 630° C., it is easy to set the area ratio of ferrite to 60% or more.

In this manner, it is possible to obtain the steel sheet according to this embodiment.

In the above-described manufacturing method, the hot rolling conditions are controlled, to thereby introduce work dislocations into the austenite. Then, it is important to make the introduced work dislocations remain moderately by controlling, the cooling conditions. That is, even when the hot rolling conditions or the cooling conditions are controlled independently, it is impossible to obtain the steel sheet according to this embodiment, resulting in that it is important to appropriately control both of the hot rolling conditions and the cooling conditions. The conditions other than the above are not limited in particular because well-known methods such as coiling by a well-known method after the second cooling, for example, only need to be used.

Pickling may be performed in order to remove scales on the surface. As long as the hot rolling and cooling conditions are as above, it is possible to obtain the similar effects even when cold rolling, a heat treatment (annealing), plating, and so on are performed thereafter.

In the cold rolling, a reduction ratio is preferably set to 90% or less. When the reduction ratio in the cold rolling exceeds 90%, the ductility sometimes decreases. The cold rolling does not have to be performed and the lower limit of the reduction ratio in the cold rolling is 0%. As above, an intact hot-rolled original sheet has excellent formability. On the other hand, on dislocations introduced by the cold rolling, solid-dissolved Ti, Nb, Mo, and so on collect to precipitate, thereby making it possible to improve a yield point (YP) and a tensile strength (TS). Thus, the cold rolling can be used for adjusting the strength. A cold-rolled steel sheet is obtained by the cold rolling.

The temperature of the heat treatment (annealing) after the cold rolling is preferably set to 840° C. or less. At the time of annealing, complicated phenomena such as strengthening by precipitation of Ti and Nb that did not precipitate sufficiently at the hot rolling stage, dislocation recovery, and softening by coarsening of precipitates occur. When the annealing temperature exceeds 840° C., the effect of coarsening of precipitates is large and the proportion of the crystal grains each having an intragranular crystal misorientation of 5 to 14° becomes short. The annealing temperature is more preferably set to 820° C. or less and further preferably set to 800° C. or less. The lower limit of the annealing temperature is not set in particular. As described above, this is because the intact hot-rolled original sheet that is not subjected to annealing has excellent formability.

On the surface of the steel sheet in this embodiment, a plating layer may be formed. That is, a plated steel sheet can be cited as another embodiment of the present invention. The plating layer is, for example, an electroplating layer, a hot-dip plating layer, or an alloyed hot-dip plating layer. As the hot-dip plating layer and the alloyed hot-dip plating layer, a layer made of at least one of zinc and aluminum, for example, can be cited. Concretely, there can be cited a hot-dip galvanizing layer, an alloyed hot-dip galvanizing layer, a hot-dip aluminum plating layer, an alloyed hot-dip aluminum plating layer, a hot-dip Zn—Al plating layer, an alloyed hot-dip Zn—Al plating layer, and so on. From the viewpoints of platability and corrosion resistance, in particular, the hot-dip galvanizing layer and the alloyed hot-dip galvanizing layer are preferable.

A hot-dip plated steel sheet and an alloyed hot-dip plated steel sheet are manufactured by performing hot dipping or alloying hot dipping on the aforementioned steel sheet according to this embodiment. Here, the alloying hot dipping means that hot dipping is performed to form a hot-dip plating layer on a surface, and then an alloying treatment is performed thereon to form the hot-dip plating layer into an alloyed hot-dip plating layer. The steel sheet that is subjected to plating may be the hot-rolled steel sheet, or a steel sheet obtained after the cold rolling and the annealing are performed on the hot-rolled steel sheet. The hot-dip plated steel sheet and the alloyed hot-dip plated steel sheet include the steel sheet according to this embodiment and have the hot-dip plating layer and the alloyed hot-dip plating layer provided thereon respectively, and thereby, it is possible to achieve an excellent rust prevention property together with the functional effects of the steel sheet according to this embodiment. Before performing plating, Ni or the like may be applied to the surface as pre-plating.

When the heat treatment (annealing) is performed on the steel sheet, the steel sheet may be immersed in a hot-dip galvanizing bath directly after being subjected to the heat treatment to form the hot-dip galvanizing layer on the surface thereof. In this case, the original sheet for the heat treatment may be the hot-rolled steel sheet or the cold-rolled steel sheet. After the hot-dip galvanizing layer is formed, the alloyed hot-dip galvanizing layer may be formed by reheating the steel sheet and performing the alloying treatment to alloy the galvanizing layer and the base iron.

The plated steel sheet according to the embodiment of the present invention has an excellent rust prevention property because the plating layer is formed on the surface of the steel sheet. Thus, when an automotive member is reduced in thickness by using the plated steel sheet in this embodiment, for example, it is possible to prevent shortening of the usable life of an automobile that is caused by corrosion of the member.

Note that the above-described embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

EXAMPLES

Next, examples of the present invention will be explained. Conditions in the examples are examples of conditions employed to verify feasibility and effects of the present invention, and the present invention is not limited to the examples of conditions. The present invention can employ various conditions without departing from the spirit of the present invention to the extent to achieve the objects of the present invention.

Steels having chemical compositions illustrated in Table 1 and Table 2 were smelted to manufacture steel billets, the obtained steel billets were heated to heating temperatures illustrated in Table 3 and Table 4 to be subjected to rough rolling under conditions illustrated in Table 3 and Table 4, and then subjected to finish rolling under conditions illustrated in Table 3 and Table 4. Sheet thicknesses of hot-rolled steel sheets after the finish rolling were 2.2 to 3.4 mm. Each blank column in Table 1 and Table 2 indicates, that an analysis value was less than a detection limit. "ELAPSED TIME" in Table 3 and Table 4 is the elapsed time between finish of the rough rolling and start of the finish rolling. Each underline in Table 1 and Table 2 indicates that a numerical value thereof is out of the range of the present invention, and each underline in Table 4 indicates that a numerical value thereof is out of the range suitable for the manufacture of the steel sheet of the present invention.

TABLE 1

| STEEL | CHEMICAL COMPOSITION (MASS %, BALANCE: Fe AND IMPURITIES) | | | | | | | | |
|---|---|---|---|---|---|---|---|---|---|
| No. | C | Si | Mn | P | S | Al | Ti | Nb | N |
| A | 0.047 | 0.41 | 0.72 | 0.011 | 0.005 | 0.050 | 0.150 | 0.031 | 0.0026 |
| B | 0.036 | 0.32 | 1.02 | 0.019 | 0.003 | 0.030 | 0.090 | 0.022 | 0.0019 |
| C | 0.070 | 1.22 | 1.21 | 0.022 | 0.006 | 0.040 | 0.110 | 0.042 | 0.0034 |
| D | 0.053 | 0.81 | 1.51 | 0.016 | 0.012 | 0.030 | 0.110 | 0.033 | 0.0027 |
| E | 0.040 | 0.22 | 0.99 | 0.013 | 0.008 | 0.030 | | 0.062 | 0.0031 |
| F | 0.041 | 0.93 | 1.23 | 0.014 | 0.010 | 0.030 | 0.150 | 0.037 | 0.0034 |
| G | 0.064 | 0.72 | 1.21 | 0.014 | 0.009 | 0.100 | 0.120 | 0.031 | 0.0043 |
| H | 0.051 | 0.53 | 1.33 | 0.016 | 0.008 | 0.030 | 0.140 | 0.041 | 0.0027 |
| I | 0.059 | 0.62 | 1.02 | 0.010 | 0.010 | 0.080 | 0.110 | 0.023 | 0.0021 |
| J | 0.031 | 0.62 | 0.73 | 0.013 | 0.006 | 0.030 | 0.110 | 0.022 | 0.0027 |
| K | 0.043 | 1.42 | 1.72 | 0.011 | 0.003 | 0.050 | 0.150 | 0.032 | 0.0035 |
| L | 0.054 | 0.43 | 1.52 | 0.014 | 0.005 | 0.040 | 0.130 | 0.041 | 0.0023 |
| M | 0.056 | 0.22 | 1.23 | 0.016 | 0.008 | 0.030 | 0.160 | 0.021 | 0.0011 |
| N | 0.066 | 0.81 | 1.41 | 0.015 | 0.007 | 0.050 | 0.090 | 0.017 | 0.0021 |
| O | 0.061 | 0.61 | 1.62 | 0.018 | 0.009 | 0.040 | 0.120 | 0.023 | 0.0027 |
| P | 0.052 | 0.81 | 1.82 | 0.015 | 0.010 | 0.030 | 0.100 | 0.033 | 0.0027 |
| Q | 0.039 | 0.13 | 1.41 | 0.010 | 0.008 | 0.200 | 0.070 | 0.012 | 0.0027 |
| R | 0.026 | 0.05 | 1.16 | 0.011 | 0.004 | 0.015 | 0.070 | | 0.0029 |
| S | 0.092 | 0.05 | 1.20 | 0.002 | 0.003 | 0.030 | 0.015 | 0.029 | 0.0030 |
| T | 0.062 | 0.06 | 1.48 | 0.017 | 0.003 | 0.035 | 0.055 | 0.035 | 0.0031 |
| U | 0.081 | 0.04 | 1.52 | 0.014 | 0.004 | 0.030 | 0.022 | 0.020 | 0.0034 |
| a | 0.162 | 0.42 | 1.22 | 0.010 | 0.006 | 0.300 | 0.080 | 0.043 | 0.0015 |
| b | 0.051 | 2.73 | 0.82 | 0.012 | 0.010 | 0.050 | 0.090 | 0.032 | 0.0024 |
| c | 0.047 | 0.23 | 3.21 | 0.015 | 0.008 | 0.040 | 0.080 | 0.041 | 0.0030 |
| d | 0.039 | 0.52 | 0.82 | 0.013 | 0.007 | 0.030 | 0.050 | 0.002 | 0.0043 |
| e | 0.064 | 0.62 | 1.72 | 0.016 | 0.012 | 0.030 | 0.250 | 0.032 | 0.0021 |
| g | 0.049 | 0.52 | 1.22 | 0.018 | 0.009 | 0.060 | 0.150 | 0.081 | 0.0027 |

TABLE 2

| STEEL | CHEMICAL COMPOSITION (MASS %, BALANCE: Fe AND IMPURITIES) | | | | | | | | | | Ar3 |
|---|---|---|---|---|---|---|---|---|---|---|---|
| No. | Cr | B | Mo | Cu | Ni | Mg | REM | Ca | Zr | Ti + Nb | (° C.) |
| A | | | | | | | | | | 0.181 | 907 |
| B | | | | | | | | | | 0.112 | 882 |
| C | | | | | | | | 0.001 | | 0.152 | 884 |
| D | 0.15 | | | | | | | | | 0.143 | 839 |
| E | | | | | | | | | | 0.062 | 878 |
| F | | | | | | | | | | 0.187 | 880 |
| G | | 0.0010 | | | | | | | | 0.151 | 870 |
| H | | | | | | | | | | 0.181 | 855 |
| I | | | | 0.06 | 0.03 | | | | 0.001 | 0.133 | 877 |
| J | | | | | | | | | | 0.132 | 918 |
| K | | | 0.13 | | | | | | | 0.182 | 838 |
| L | | | | | | | 0.005 | | | 0.171 | 832 |
| M | | | | 0.08 | 0.04 | | | | | 0.181 | 842 |
| N | | | | | | | | | | 0.107 | 852 |
| O | | | | | | 0.0003 | | | | 0.143 | 828 |
| P | | | | | | | | | | 0.133 | 818 |
| Q | | | | | | | | | | 0.082 | 843 |
| R | | | | | | | | | | 0.070 | 860 |
| S | | | | | | | | | | 0.044 | 833 |
| T | | | | | | | | | | 0.090 | 822 |
| U | | | | | | | | | | 0.042 | 811 |
| a | | | | | | | | | | 0.123 | 834 |
| b | | | | | | | | 0.0006 | | 0.122 | 974 |
| c | | | | | | | | | | 0.121 | 673 |
| d | | 0.0030 | | | | | | | | 0.007 | 904 |
| e | | | | | | | | | | 0.282 | 817 |
| g | | | | | | | | | | 0.231 | 867 |

TABLE 3

| TEST No. | STEEL No. | Ar3 (° C.) | SRT min (° C.) | HEATING TEMPER-ATURE (° C.) | ROUGH ROLLING FINISHING TEMPERATURE (° C.) | ELAPSED TIME (SECOND) | FINISH ROLLING FINISHING TEMPERATURE (° C.) | CUMULATIVE STRAIN AT FINAL THREE STAGES OF FINISH ROLLING | MAXIMUM TEMPERATURE OF STEEL SHEET AT FINISH ROLLING TIME (° C.) |
|---|---|---|---|---|---|---|---|---|---|
| 1 | A | 907 | 1141 | 1199 | 1056 | 90 | 918 | 0.57 | 1047 |
| 2 | B | 882 | 1071 | 1172 | 1069 | 60 | 902 | 0.57 | 1017 |
| 3 | C | 884 | 1179 | 1228 | 1065 | 80 | 912 | 0.58 | 1006 |
| 4 | D | 839 | 1139 | 1209 | 1100 | 50 | 886 | 0.56 | 985 |
| 5 | E | 878 | 1051 | 1173 | 1090 | 70 | 903 | 0.54 | 1006 |
| 6 | F | 880 | 1133 | 1202 | 1090 | 90 | 928 | 0.54 | 1018 |
| 7 | G | 870 | 1162 | 1171 | 1057 | 80 | 912 | 0.55 | 990 |
| 8 | H | 855 | 1158 | 1230 | 1060 | 50 | 921 | 0.58 | 1002 |
| 9 | I | 877 | 1134 | 1215 | 1091 | 60 | 897 | 0.59 | 998 |
| 10 | J | 918 | 1067 | 1238 | 1097 | 90 | 948 | 0.59 | 1021 |
| 11 | K | 838 | 1135 | 1194 | 1090 | 90 | 895 | 0.53 | 973 |
| 12 | L | 832 | 1161 | 1210 | 1068 | 70 | 921 | 0.58 | 977 |
| 13 | M | 842 | 1149 | 1224 | 1051 | 90 | 917 | 0.55 | 961 |
| 14 | N | 852 | 1120 | 1170 | 1100 | 80 | 892 | 0.54 | 980 |
| 15 | O | 828 | 1143 | 1192 | 1095 | 80 | 894 | 0.60 | 973 |
| 16 | P | 818 | 1131 | 1174 | 1072 | 90 | 886 | 0.57 | 950 |
| 17 | Q | 843 | 1041 | 1194 | 1079 | 50 | 915 | 0.58 | 980 |
| 18 | R | 860 | 1000 | 1240 | 1074 | 90 | 930 | 0.55 | 965 |
| 19 | S | 833 | 1079 | 1246 | 1096 | 80 | 913 | 0.56 | 940 |
| 20 | T | 822 | 1117 | 1249 | 1073 | 80 | 942 | 0.59 | 968 |
| 21 | U | 811 | 1069 | 1241 | 1056 | 60 | 910 | 0.59 | 951 |

TABLE 4

| TEST No. | STEEL No. | Ar3 (° C.) | SRT min (° C.) | HEATING TEMPER-ATURE (° C.) | ROUGH ROLLING FINISHING TEMPERATURE (° C.) | ELAPSED TIME (SECOND) | FINISH ROLLING FINISHING TEMPERATURE (° C.) | CUMULATIVE STRAIN AT FINAL THREE STAGES OF FINISH ROLLING | MAXIMUM TEMPERATURE OF STEEL SHEET AT FINISH ROLLING TIME (° C.) |
|---|---|---|---|---|---|---|---|---|---|
| 22 | a | 834 | 1257 | 1200 | 1078 | 70 | 901 | 0.56 | 1000 |
| 23 | b | 974 | 1120 | 1171 | 1063 | 60 | 999 | 0.58 | 1060 |
| 24 | c | 673 | 1116 | 1202 | 1079 | 60 | 778 | 0.60 | 820 |
| 25 | d | 904 | 962 | 1210 | 1081 | 70 | 913 | 0.57 | 984 |
| 26 | e | 817 | 1212 | 1275 | 1092 | 70 | 886 | 0.55 | 950 |
| 27 | g | 867 | 1191 | 1217 | 1061 | 50 | 914 | 0.57 | 970 |
| 28 | M | 842 | 1149 | 1120 | 1062 | 90 | 906 | 0.57 | 990 |
| 29 | C | 884 | 1179 | 1194 | 1075 | 70 | 840 | 0.54 | 1020 |
| 30 | C | 884 | 1179 | 1194 | 1091 | 70 | 897 | 0.44 | 1015 |
| 31 | C | 884 | 1179 | 1194 | 1076 | 70 | 913 | 0.70 | 1020 |
| 32 | C | 884 | 1179 | 1215 | 1078 | 80 | 951 | 0.59 | 1070 |
| 33 | C | 884 | 1179 | 1198 | 1089 | 90 | 914 | 0.58 | 1000 |
| 34 | C | 884 | 1179 | 1195 | 1080 | 90 | 930 | 0.58 | 990 |
| 35 | M | 842 | 1149 | 1193 | 1060 | 70 | 902 | 0.54 | 980 |
| 36 | M | 842 | 1149 | 1174 | 1083 | 90 | 903 | 0.55 | 970 |
| 37 | M | 842 | 1149 | 1204 | 1074 | 90 | 903 | 0.58 | 990 |
| 38 | M | 842 | 1149 | 1210 | 1087 | 60 | 914 | 0.58 | 988 |
| 39 | M | 842 | 1149 | 1216 | 1073 | 90 | 913 | 0.59 | 993 |
| 40 | M | 842 | 1149 | 1213 | 1061 | 50 | 905 | 0.55 | 988 |
| 41 | M | 842 | 1149 | 1221 | 980 | 50 | 912 | 0.56 | 989 |
| 42 | M | 842 | 1149 | 1223 | 1074 | 10 | 921 | 0.55 | 969 |
| 43 | M | 842 | 1149 | 1223 | 1098 | 90 | 916 | 0.57 | 978 |
| 44 | M | 842 | 1149 | 1222 | 1088 | 90 | 904 | 0.55 | 976 |
| 45 | M | 842 | 1149 | 1211 | 1068 | 90 | 902 | 0.53 | 979 |

$Ar_3$ (° C.) was obtained from the components illustrated in Table 1 and Table 2 by using Expression (3).

$$Ar_3=970-325\times[C]+33\times[Si]+287\times[P]+40\times[Al]-92\times([Mn]+[Mo]+[Cu])-46\times([Cr]+[Ni]) \quad (3)$$

The cumulative strain at the final three stages was obtained by Expression (2)

$$\varepsilon eff.=\Sigma\varepsilon i(t,T) \quad (2)$$

Here, $\varepsilon i(t,T)=\varepsilon i0/\exp\{(t/\tau R)^{2/3}\}$, $\tau R=\tau 0\cdot\exp(Q/RT)$, $\tau 0=8.46\times10^{-9}$, $Q=183200J$, $R=8.314J/K\cdot mol$, $\varepsilon i0$ represents a logarithmic strain at a reduction time, t represents a cumulative time period till immediately before the cooling in the pass, and T represents a rolling temperature in the pass.

Next, under conditions illustrated in Table 5 and Table 6, of the hot-rolled steel sheets, air cooling, first cooling, retention in a first temperature zone, and second cooling were performed, and hot-rolled steel sheets of Test No. 1 to 45 were obtained. An air cooling time period is equivalent to the time between finish of the finish rolling and start of the first cooling.

The hot-rolled steel sheet of Test No. 21 was subjected to cold rolling at a reduction ratio illustrated in Table 5 and subjected to a heat treatment at a heat treatment temperature illustrated in Table 5, and then had a, hot-dip galvanizing layer formed thereon, and further an alloying treatment was performed to thereby form an alloyed hot-dip galvanizing layer (GA) on a surface. The hot-rolled steel sheets of Test No. 18 to 20, and 45 were subjected to a heat treatment at heat treatment temperatures illustrated in Table 5 and Table 6. The hot-rolled steel sheets of Test No. 18 to 20 were subjected to a heat treatment, and then had hot-dip galvanizing layers (GI) each formed thereon. Each underline in Table 6 indicates that a numerical value thereof is out of the range suitable for the manufacture of the steel sheet of the present invention.

TABLE 5

| TEST No. | STEEL No. | AIR COOLING TIME PERIOD (SECOND) | COOLING RATE OF FIRST COOLING (° C./s) | COOLING STOP TEMPERATURE OF FIRST COOLING (° C.) | RETENTION TIME IN FIRST TEMPERATURE ZONE (SECOND) | COOLING RATE OF SECOND COOLING (° C./s) | COOLING STOP TEMPERATURE OF SECOND COOLING (° C.) | COLD ROLLING REDUCTION RATIO (%) | HEAT TREATMENT TEMPERATURE (° C.) | PLATING |
|---|---|---|---|---|---|---|---|---|---|---|
| 1 | A | 3.7 | 32 | 690 | 3 | 35 | 570 | NONE | NONE | NONE |
| 2 | B | 4.4 | 39 | 640 | 4 | 40 | 580 | NONE | NONE | NONE |
| 3 | C | 2.7 | 41 | 610 | 2 | 45 | 600 | NONE | NONE | NONE |
| 4 | D | 3.1 | 55 | 630 | 5 | 35 | 620 | NONE | NONE | NONE |
| 5 | E | 2.5 | 42 | 650 | 3 | 40 | 590 | NONE | NONE | NONE |
| 6 | F | 3.5 | 45 | 620 | 4 | 50 | 565 | NONE | NONE | NONE |
| 7 | G | 2.9 | 57 | 660 | 6 | 33 | 510 | NONE | NONE | NONE |
| 8 | H | 2.6 | 30 | 670 | 3 | 40 | 570 | NONE | NONE | NONE |
| 9 | I | 2.8 | 55 | 630 | 2 | 35 | 620 | NONE | NONE | NONE |
| 10 | J | 2.5 | 48 | 680 | 4 | 40 | 600 | NONE | NONE | NONE |
| 11 | K | 3.8 | 40 | 690 | 8 | 36 | 640 | NONE | NONE | NONE |
| 12 | L | 3.3 | 77 | 650 | 3 | 60 | 570 | NONE | NONE | NONE |
| 13 | M | 3.9 | 73 | 640 | 2 | 54 | 550 | NONE | NONE | NONE |
| 14 | N | 2.5 | 59 | 650 | 4 | 65 | 530 | NONE | NONE | NONE |
| 15 | O | 2.7 | 62 | 660 | 6 | 36 | 540 | NONE | NONE | NONE |
| 16 | P | 2.8 | 37 | 630 | 5 | 55 | 580 | NONE | NONE | NONE |
| 17 | Q | 2.8 | 37 | 680 | 5 | 49 | 620 | NONE | NONE | NONE |
| 18 | R | 3.1 | 59 | 660 | 3 | 30 | 600 | NONE | 700 | GI |
| 19 | S | 3.8 | 63 | 660 | 3 | 30 | 630 | NONE | 700 | GI |
| 20 | T | 2.8 | 62 | 620 | 3 | 30 | 600 | NONE | 700 | GI |
| 21 | U | 3.6 | 74 | 610 | 3 | 30 | 550 | 62% | 750 | GA |

TABLE 6

| TEST No. | STEEL No. | AIR COOLING TIME PERIOD (SECOND) | COOLING RATE OF FIRST COOLING (° C./s) | COOLING STOP TEMPERATURE OF FIRST COOLING (° C.) | RETENTION TIME IN FIRST TEMPERATURE ZONE (SECOND) | COOLING RATE OF SECOND COOLING (° C./s) | COOLING STOP TEMPERATURE OF SECOND COOLING (° C.) | COLD ROLLING REDUCTION RATIO (%) | HEAT TREATMENT TEMPERATURE (° C.) | PLATING |
|---|---|---|---|---|---|---|---|---|---|---|
| 22 | a | 2.8 | 44 | 690 | 4 | 35 | 600 | NONE | NONE | NONE |
| 23 | b | 4 | 48 | 690 | 5 | 45 | 570 | NONE | NONE | NONE |
| 24 | c | 4.1 | 60 | 700 | 6 | 37 | 560 | NONE | NONE | NONE |
| 25 | d | 3.1 | 33 | 670 | 2 | 42 | 550 | NONE | NONE | NONE |
| 26 | e | 2.5 | 42 | 640 | 3 | 53 | 540 | NONE | NONE | NONE |
| 27 | g | 3.1 | 55 | 710 | 4 | 46 | 650 | NONE | NONE | NONE |
| 28 | M | 4.2 | 45 | 690 | 4 | 35 | 570 | NONE | NONE | NONE |
| 29 | C | 2.9 | 27 | 740 | 3 | 50 | 590 | NONE | NONE | NONE |
| 30 | C | 3.4 | 36 | 720 | 6 | 43 | 600 | NONE | NONE | NONE |
| 31 | C | 3.2 | 61 | 710 | 3 | 54 | 570 | NONE | NONE | NONE |
| 32 | C | 3.6 | 49 | 720 | 3 | 43 | 550 | NONE | NONE | NONE |

TABLE 6-continued

| TEST No. | STEEL No. | AIR COOLING TIME PERIOD (SECOND) | COOLING RATE OF FIRST COOLING (° C./s) | COOLING STOP TEMPERATURE OF FIRST COOLING (° C.) | RETENTION TIME IN FIRST TEMPERATURE ZONE (SECOND) | COOLING RATE OF SECOND COOLING (° C./s) | COOLING STOP TEMPERATURE OF SECOND COOLING (° C.) | COLD ROLLING REDUCTION RATIO (%) | HEAT TREATMENT TEMPERATURE (° C.) | PLATING |
|---|---|---|---|---|---|---|---|---|---|---|
| 33 | C | 4.4 | 5 | 680 | 6 | 35 | 570 | NONE | NONE | NONE |
| 34 | C | 4 | 39 | 530 | 4 | 36 | 520 | NONE | NONE | NONE |
| 35 | M | 3.3 | 56 | 795 | 5 | 35 | 620 | NONE | NONE | NONE |
| 36 | M | 3.7 | 35 | 710 | 0 | 48 | 560 | NONE | NONE | NONE |
| 37 | M | 3.9 | 36 | 650 | 15 | 45 | 550 | NONE | NONE | NONE |
| 38 | M | 2.9 | 37 | 700 | 4 | 5 | 570 | NONE | NONE | NONE |
| 39 | M | 4.5 | 47 | 600 | 5 | 43 | 360 | NONE | NONE | NONE |
| 40 | M | 3.5 | 42 | 700 | 3 | 35 | 670 | NONE | NONE | NONE |
| 41 | M | 4.3 | 60 | 700 | 2 | 54 | 550 | NONE | NONE | NONE |
| 42 | M | 2.8 | 71 | 680 | 2 | 54 | 550 | NONE | NONE | NONE |
| 43 | M | 0.5 | 73 | 670 | 2 | 54 | 550 | NONE | NONE | NONE |
| 44 | M | 8 | 60 | 710 | 2 | 54 | 550 | NONE | NONE | NONE |
| 45 | M | 2.7 | 41 | 730 | 3 | 35 | 650 | NONE | 860 | NONE |

Then, of each of the steel sheets (the hot-rolled steel sheets of Test No. 1 to 17 and 22 to 44, the heat-treated hot-rolled steel sheets of Test No. 18 to 20, and 45, and a heat-treated cold-rolled steel sheet of Test No. 21), structural fractions (area ratios) of ferrite, bainite, martensite, and pearlite and a proportion of crystal, grains, each having an intragranular misorientation of 5 to 14° were obtained by the following methods. Results thereof are illustrated in Table 7 and Table 8. The case where martensite and/or pearlite are/is contained was described in the column of "BALANCE STRUCTURE" in the table. Each underline in Table 8 indicates that a numerical value thereof is out of the range of the present invention.

"Structural Fractions (Area Ratios) of Ferrite, Bainite, Martensite, and Pearlite"

First, a sample collected from the steel sheet was etched by nital. After the etching, a structure photograph obtained at a ¼ depth position of the sheet thickness in a visual field of 300 μm×300 μm was subjected to an image analysis by using an optical microscope. By this image analysis, the area ratio of ferrite, the area ratio of pearlite, and the total area ratio of bainite and martensite were obtained. Next, a sample etched by LePera was used, and a structure photograph obtained at a ¼ depth position of the sheet thickness in a visual field of 300 μm×300 μm was subjected to an image analysis by using an optical microscope. By this image analysis, the total area ratio of retained austenite and martensite was obtained. Further, a sample obtained by grinding the surface to a depth of ¼ of the sheet thickness from a direction normal to a rolled surface was used, and the volume fraction of the retained austenite was obtained through an X-ray diffraction measurement. The volume fraction of the retained austenite was equivalent to the area ratio, and thus was set as the area ratio of the retained austenite. Then, the area ratio of martensite was obtained by subtracting the area ratio of the retained austenite from the total area ratio of the retained austenite and the martensite, and the area ratio of bainite was obtained by subtracting the area ratio of the martensite from the total area ratio of the bainite and the martensite. In this manner, the area ratio of each of ferrite, bainite, martensite, retained austenite, and pearlite was obtained.

"Proportion of Crystal Grains Each Having an Intragranular Misorientation of 5 to 14°"

At a ¼ depth position of a sheet thickness t from the surface of the steel sheet (¼ t portion) in a cross section vertical to a rolling direction, a region of 200 μm in the rolling direction and 100 μm in a direction normal to the rolled surface was subjected to an EBSD analysis at a measurement pitch of 0.2 μm to obtain crystal orientation information. Here, the EBSD analysis was performed by using an apparatus composed of a thermal field emission scanning electron microscope (JSM-7001F manufactured by JEOL Ltd.) and an EBSD detector (HIKARI detector manufactured by TSL Co., Ltd.), at an analysis speed of 208 to 308 points/second. Next, with respect to the obtained crystal orientation information, a region having a misorientation of 15° or more and a circle-equivalent diameter of 0.3 μm or more was defined as a crystal grain, the average intragranular misorientation of crystal grains was calculated, and the proportion of the crystal grains each having an intragranular misorientation of 5 to 14° was obtained. The crystal grain defined as described above and the average intragranular misorientation were calculated by using software "OIM Analysis (registered trademark)" attached to an EBSD analyzer.

Of each of the steel sheets (the hot-rolled steel sheets of Test No. 1 to 17 and 22 to 44, the heat-treated hot-rolled steel sheets of Test No. 18 to 20, and 45, and the heat-treated cold-rolled, steel sheet of Test No. 21), an average aspect ratio of ellipses equivalent to crystal grains and an average distribution density of the total of Ti-based carbides and Nb-based carbides each having a grain size of 20 nm or more on ferrite grain boundaries were obtained by the following methods. Results thereof are illustrated in Table 7 and Table 8.

"Average Aspect Ratio of Ellipses Equivalent to Crystal Grains"

Figure 2:
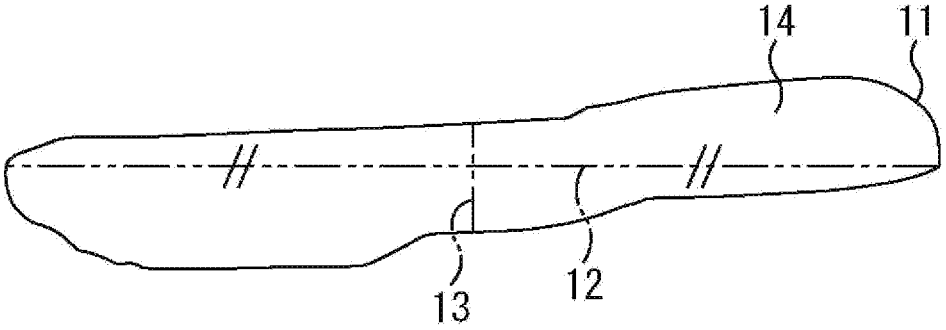
FIG. 2 is a view illustrating a method of calculating an average aspect ratio of a crystal grain.

A structure of an L cross section (cross section parallel to the rolling direction) was observed by using the above-described EBSD, (ellipse major axis length)/(ellipse minor axis length) of each of 50 or more crystal grains was calculated, and an average value of calculated values was obtained. FIG. 2 is a view illustrating a method of calculating the average aspect ratio of a crystal grain. A crystal grain 14 illustrated in FIG. 2 is a grain surrounded by a high-angle tilt grain boundary with a grain boundary tilt angle of 15° or more. As illustrated in FIG. 2, an ellipse major axis 12 means the longest straight line out of straight lines each connecting arbitrary two points, on a grain boundary 11 of each crystal grain 14 observed by using the above-described EBSD. An ellipse minor axis 13 means, out of straight lines each connecting arbitrary two points on the grain boundary 11 of each crystal grain 14 observed by using the above-described EBSD, the straight line that passes through a point equally dividing the length of the ellipse major axis 12, in half and is perpendicular to the ellipse major axis 12.

"Average Distribution Density of the Total of Ti-based Carbides and Nb-Based Carbides Each Having a Grain Size of 20 nm or More on Ferrite Grain Boundaries"

An L cross section was observed by using a SEM, the length of ferrite grain boundaries was measured, and further the total number of Ti-based carbides and Nb-based carbides each having a grain size of 20 nm or more on the ferrite grain boundaries was counted. The counted total number of Ti-based carbides and Nb-based carbides was used to calculate the average distribution density being the total number of Ti-based carbides and Nb-based carbides per 1 μm of the length of the ferrite grain boundaries. Incidentally, the grain size of the Ti-based carbide and the Nb-based carbide means a circle equivalent radius of the Ti-based carbide and the Nb-based carbide.

TABLE 7

| TEST No. | FERRITE AREA RATIO (%) | BAINITE AREA RATIO (%) | BALANCE STRUCTURE (%) | PROPORTION OF CRYSTAL GRAINS EACH HAVING INTRA-GRANULAR MISORIENTATION OF 5 TO 14° (%) | AVERAGE ASPECT RATIO | DENSITY OF TOTAL OF Ti-BASED CARBIDES AND Nb-BASED CARBIDES ON GRAIN BOUNDARIES (CARBIDE/μm) | NOTE |
|---|---|---|---|---|---|---|---|
| 1 | 35 | 65 | 0 | 54 | 3.5 | 2.00 | PRESENT INVENTION EXAMPLE |
| 2 | 60 | 40 | 0 | 79 | 3.5 | 1.00 | PRESENT INVENTION EXAMPLE |
| 3 | 40 | 60 | 0 | 72 | 3.5 | 3.00 | PRESENT INVENTION EXAMPLE |
| 4 | 60 | 40 | 0 | 71 | 3.0 | 4.00 | PRESENT INVENTION EXAMPLE |
| 5 | 50 | 50 | 0 | 39 | 3.0 | 4.00 | PRESENT INVENTION EXAMPLE |
| 6 | 38 | 62 | 0 | 52 | 3.1 | 3.00 | PRESENT INVENTION EXAMPLE |
| 7 | 49 | 51 | 0 | 68 | 3.3 | 2.00 | PRESENT INVENTION EXAMPLE |
| 8 | 50 | 50 | 0 | 75 | 3.3 | 4.00 | PRESENT INVENTION EXAMPLE |
| 9 | 49 | 51 | 0 | 73 | 3.4 | 2.00 | PRESENT INVENTION EXAMPLE |
| 10 | 50 | 50 | 0 | 77 | 2.9 | 3.00 | PRESENT INVENTION EXAMPLE |
| 11 | 40 | 60 | 0 | 52 | 3.2 | 4.00 | PRESENT INVENTION EXAMPLE |
| 12 | 65 | 35 | 0 | 82 | 3.4 | 2.00 | PRESENT INVENTION EXAMPLE |
| 13 | 48 | 52 | 0 | 67 | 3.0 | 2.00 | PRESENT INVENTION EXAMPLE |
| 14 | 50 | 50 | 0 | 56 | 2.8 | 3.00 | PRESENT INVENTION EXAMPLE |
| 15 | 40 | 60 | 0 | 86 | 3.4 | 2.00 | PRESENT INVENTION EXAMPLE |
| 16 | 30 | 70 | 0 | 89 | 3.0 | 1.00 | PRESENT INVENTION EXAMPLE |
| 17 | 60 | 40 | 0 | 91 | 3.2 | 3.00 | PRESENT INVENTION EXAMPLE |
| 18 | 40 | 60 | 0 | 85 | 3.2 | 3.00 | PRESENT INVENTION EXAMPLE |
| 19 | 75 | 25 | 0 | 84 | 3.4 | 3.00 | PRESENT INVENTION EXAMPLE |
| 20 | 38 | 62 | 0 | 72 | 3.3 | 1.00 | PRESENT INVENTION EXAMPLE |
| 21 | 45 | 55 | 0 | 92 | 2.9 | 2.00 | PRESENT INVENTION EXAMPLE |

TABLE 8

| TEST No. | FERRITE AREA RATIO (%) | BAINITE AREA RATIO (%) | BALANCE STRUCTURE (%) | PROPORTION OF CRYSTAL GRAINS EACH HAVING INTRA-GRANULAR MISORIENTATION OF 5 TO 14° (%) | AVERAGE ASPECT RATIO | DENSITY OF TOTAL OF Ti-BASED CARBIDES AND Nb-BASED CARBIDES ON GRAIN BOUNDARIES (CARBIDE/μm) | |
|---|---|---|---|---|---|---|---|
| 22 | 0 | 55 | 8% PEARLITE, BALANCE MARTENSITE | 18 | 3.1 | 3.00 | COMPARATIVE EXAMPLE |
| 23 | 100 | 0 | 0 | 10 | 3.2 | 4.00 | COMPARATIVE EXAMPLE |
| 24 | 3 | 35 | BALANCE MARTENSITE | 27 | 3.3 | 1.00 | COMPARATIVE EXAMPLE |
| 25 | 67 | 33 | 0 | 28 | 2.8 | 1.00 | COMPARATIVE EXAMPLE |
| 26 | CRACK OCCURRED DURING ROLLING | | | | | | COMPARATIVE EXAMPLE |
| 27 | 73 | 27 | 0 | 6 | 3.2 | 4.00 | COMPARATIVE EXAMPLE |
| 28 | 76 | 24 | 0 | 18 | 3.4 | 4.00 | COMPARATIVE EXAMPLE |
| 29 | 80 | 20 | 0 | 3 | 5.3 | 4.00 | COMPARATIVE EXAMPLE |
| 30 | 75 | 25 | 0 | 15 | 5.5 | 4.00 | COMPARATIVE EXAMPLE |
| 31 | 55 | 45 | 0 | 13 | 2.9 | 4.00 | COMPARATIVE EXAMPLE |
| 32 | 50 | 50 | 0 | 5 | 3.3 | 3.00 | COMPARATIVE EXAMPLE |
| 33 | 45 | 55 | 0 | 17 | 3.1 | 4.00 | COMPARATIVE EXAMPLE |
| 34 | 5 | 95 | 0 | 6 | 3.0 | 4.00 | COMPARATIVE EXAMPLE |
| 35 | 75 | 25 | 0 | 18 | 3.3 | 15.00 | COMPARATIVE EXAMPLE |
| 36 | 3 | 97 | 0 | 16 | 3.4 | 2.00 | COMPARATIVE EXAMPLE |
| 37 | 65 | 35 | 0 | 14 | 3.2 | 2.00 | COMPARATIVE EXAMPLE |
| 38 | 60 | 40 | 0 | 12 | 2.8 | 1.00 | COMPARATIVE EXAMPLE |

TABLE 8-continued

| TEST No. | FERRITE AREA RATIO (%) | BAINITE AREA RATIO (%) | BALANCE STRUCTURE (%) | PROPORTION OF CRYSTAL GRAINS EACH HAVING INTRA-GRANULAR MISORIENTATION OF 5 TO 14° (%) | AVERAGE ASPECT RATIO | DENSITY OF TOTAL OF Ti-BASED CARBIDES AND Nb-BASED CARBIDES ON GRAIN BOUNDARIES (CARBIDE/μm) | |
|---|---|---|---|---|---|---|---|
| 39 | 40 | 60 | 0 | 8 | 3.4 | 4.00 | COMPARATIVE EXAMPLE |
| 40 | 80 | 20 | 0 | 8 | 2.8 | 4.00 | COMPARATIVE EXAMPLE |
| 41 | 70 | 30 | 0 | 60 | 5.4 | 3.00 | COMPARATIVE EXAMPLE |
| 42 | 60 | 40 | 0 | 57 | 5.3 | 3.00 | COMPARATIVE EXAMPLE |
| 43 | 50 | 50 | 0 | 56 | 5.4 | 2.00 | COMPARATIVE EXAMPLE |
| 44 | 55 | 45 | 0 | 53 | 5.5 | 3.00 | COMPARATIVE EXAMPLE |
| 45 | 60 | 20 | BALANCE MARTENSITE | 8 | 3.0 | 4.00 | COMPARATIVE EXAMPLE |

On each of the steel sheets (the hot-rolled steel sheets of Test No. 1 to 17 and 22 to 44, the heat-treated hot-rolled steel sheets of Test No. 18 to 20, and 45, and the heat-treated cold-rolled steel sheet of Test No. 21), a plane bending fatigue test was performed under a condition of a stress ratio=1 according to JIS Z2275 to perform evaluation by a fatigue limit. Of each of the steel sheets (the hot-rolled steel sheets of Test No. 1 to 17 and 22 to 44, the heat-treated hot-rolled steel sheets of Test No. 18 to 20, and 45, and the heat-treated cold-rolled steel sheet of Test No. 21), in a tensile test, a yield strength and a tensile strength were obtained, and by a saddle-type stretch-flange test, a limit form height of a flange was obtained. Then, the product of the tensile strength (MPa) and the limit form height (mm) was set as an index of the stretch flangeability, and the case of the product being 19500 mm·MPa or more was judged to be excellent in stretch flangeability. Further, the case of the tensile strength (TS) being 480 MPa or more was judged to be high in strength. Further, the case where the percent brittle fracture at a punching time is less than 20% and the fatigue limit ratio is 0.4 or more was judged to be good in fatigue property of the base metal and the punched portion. Results thereof are illustrated in Table 9 and Table 10. Each underline in Table 10 indicates that a numerical value thereof is out of a desirable range.

As for the tensile test, a JIS No. 5 tensile test piece was collected from a direction right angle to the rolling direction, and this test piece was used to perform the test according to JISZ2241.

The saddle-type stretch-flange test was performed by using a saddle-type formed product in which a radius of curvature R of a corner is set to 60 mm and an opening angle θ is set to 120° and setting a clearance at the time of punching the corner portion to 11%. The limit form height was set to a limit form height with no existence of cracks by visually observing whether or not a crack having a length of ⅓ or more of the sheet thickness exists after forming.

As for the percent brittle fracture at a punching time, 20 to 50 sample steel sheets were, each punched into a circular shape by shears or a punch under a condition of a clearance being 10 to 15% of the sheet thickness and formed fracture surfaces were each observed by a microscope. Then, a metallic luster portion was set as a brittle fracture surface and the length of the brittle fracture surface in a circumferential direction was measured. Here, the length of the brittle fracture surface in the circumferential direction is the length between ends of a region to be the brittle fracture surface in the circumferential direction. Then, the proportion of the total circumferential length of the brittle fracture surfaces to all the circumferential lengths of the observed sample steel sheets was set as the percent brittle fracture. For example, in the case where 20 sample steel sheets were each punched by a punch with a 10 mm diameter, the total of circumferential lengths becomes 20×10×π mm. In the case where only one of the 20 sample steel sheets has a brittle fracture surface and the length of the brittle fracture surface in the circumferential direction is 1 mm, the percent brittle fracture becomes 1/(20×10×π).

The fatigue limit ratio was calculated by dividing the value of the fatigue limit of each of the steel sheets measured by the above-described method by the tensile strength (the fatigue limit (MPa)/the tensile strength (MPa)).

TABLE 9

| TEST No. | YIELD STRENGTH (MPa) | TENSILE STRENGTH (MPa) | PERCENT BRITTLE FRACTURE (%) | FATIGUE LIMIT (MPa) | FATIGUE LIMIT RATIO | INDEX OF STRETCH FLANGEABILITY (mm · MPa) | NOTE |
|---|---|---|---|---|---|---|---|
| 1 | 585 | 666 | 5 | 280 | 0.42 | 21457 | PRESENT INVENTION EXAMPLE |
| 2 | 576 | 611 | 7 | 269 | 0.44 | 23175 | PRESENT INVENTION EXAMPLE |
| 3 | 756 | 815 | 4 | 359 | 0.44 | 22254 | PRESENT INVENTION EXAMPLE |
| 4 | 675 | 788 | 4 | 331 | 0.42 | 22784 | PRESENT INVENTION EXAMPLE |
| 5 | 515 | 609 | 6 | 256 | 0.42 | 20598 | PRESENT INVENTION EXAMPLE |
| 6 | 707 | 806 | 6 | 346 | 0.43 | 20554 | PRESENT INVENTION EXAMPLE |
| 7 | 610 | 724 | 6 | 304 | 0.42 | 21416 | PRESENT INVENTION EXAMPLE |
| 8 | 683 | 777 | 3 | 334 | 0.43 | 22505 | PRESENT INVENTION EXAMPLE |
| 9 | 571 | 619 | 4 | 266 | 0.43 | 23138 | PRESENT INVENTION EXAMPLE |
| 10 | 556 | 648 | 5 | 285 | 0.44 | 22149 | PRESENT INVENTION EXAMPLE |
| 11 | 765 | 840 | 5 | 361 | 0.43 | 21053 | PRESENT INVENT/ON EXAMPLE |

TABLE 9-continued

| TEST No. | YIELD STRENGTH (MPa) | TENSILE STRENGTH (MPa) | PERCENT BRITTLE FRACTURE (%) | FATIGUE LIMIT (MPa) | FATIGUE LIMIT RATIO | INDEX OF STRETCH FLANGEABILITY (mm · MPa) | NOTE |
|---|---|---|---|---|---|---|---|
| 12 | 679 | 843 | 3 | 371 | 0.44 | 22584 | PRESENT INVENTION EXAMPLE |
| 13 | 650 | 698 | 2 | 293 | 0.42 | 21512 | PRESENT INVENTION EXAMPLE |
| 14 | 577 | 670 | 3 | 288 | 0.43 | 22293 | PRESENT INVENTION EXAMPLE |
| 15 | 572 | 715 | 6 | 300 | 0.42 | 23599 | PRESENT INVENTION EXAMPLE |
| 16 | 722 | 783 | 4 | 337 | 0.43 | 22652 | PRESENT INVENTION EXAMPLE |
| 17 | 526 | 601 | 4 | 264 | 0.44 | 22459 | PRESENT INVENTION EXAMPLE |
| 18 | 543 | 596 | 5 | 256 | 0.43 | 22848 | PRESENT INVENTION EXAMPLE |
| 19 | 470 | 540 | 3 | 232 | 0.43 | 28124 | PRESENT INVENTION EXAMPLE |
| 20 | 602 | 685 | 3 | 301 | 0.44 | 23524 | PRESENT INVENTION EXAMPLE |
| 21 | 605 | 685 | 3 | 288 | 0.42 | 25679 | PRESENT INVENTION EXAMPLE |

TABLE 10

| TEST No. | YIELD STRENGTH (MPa) | TENSILE STRENGTH (MPa) | PERCENT BRITTLE FRACTURE (%) | FATIGUE LIMIT (MPa) | FATIGUE LIMIT RATIO | INDEX OF STRETCH FLANGEABILITY (mm · MPa) | NOTE |
|---|---|---|---|---|---|---|---|
| 22 | 678 | 868 | 3 | 382 | 0.44 | 17984 | COMPARATIVE EXAMPLE |
| 23 | 628 | 643 | 3 | 283 | 0.44 | 18621 | COMPARATIVE EXAMPLE |
| 24 | 880 | 998 | 5 | 439 | 0.44 | 10424 | COMPARATIVE EXAMPLE |
| 25 | 334 | 470 | 3 | 219 | 0.42 | 14310 | COMPARATIVE EXAMPLE |
| 26 | CRACK OCCURRED DURING ROLLING | | | | | | COMPARATIVE EXAMPLE |
| 27 | 895 | 998 | 4 | 419 | 0.42 | 8072 | COMPARATIVE EXAMPLE |
| 28 | 488 | 576 | 6 | 242 | 0.42 | 17961 | COMPARATIVE EXAMPLE |
| 29 | 662 | 725 | 25 | 312 | 0.43 | 17526 | COMPARATIVE EXAMPLE |
| 30 | 749 | 809 | 27 | 348 | 0.43 | 19165 | COMPARATIVE EXAMPLE |
| 31 | 762 | 820 | 2 | 353 | 0.43 | 18670 | COMPARATIVE EXAMPLE |
| 32 | 745 | 782 | 3 | 344 | 0.44 | 18630 | COMPARATIVE EXAMPLE |
| 33 | 758 | 772 | 3 | 332 | 0.43 | 18328 | COMPARATIVE EXAMPLE |
| 34 | 754 | 817 | 3 | 351 | 0.43 | 16728 | COMPARATIVE EXAMPLE |
| 35 | 562 | 650 | 4 | 247 | 0.38 | 17807 | COMPARATIVE EXAMPLE |
| 36 | 654 | 737 | 5 | 317 | 0.43 | 16718 | COMPARATIVE EXAMPLE |
| 37 | 707 | 744 | 6 | 312 | 0.42 | 17653 | COMPARATIVE EXAMPLE |
| 38 | 565 | 679 | 2 | 292 | 0.43 | 17145 | COMPARATIVE EXAMPLE |
| 39 | 601 | 745 | 7 | 328 | 0.44 | 16870 | COMPARATIVE EXAMPLE |
| 40 | 566 | 673 | 4 | 296 | 0.44 | 18157 | COMPARATIVE EXAMPLE |
| 41 | 654 | 698 | 25 | 300 | 0.43 | 21512 | COMPARATIVE EXAMPLE |
| 42 | 642 | 703 | 21 | 309 | 0.44 | 21301 | COMPARATIVE EXAMPLE |
| 43 | 650 | 693 | 21 | 291 | 0.42 | 21512 | COMPARATIVE EXAMPLE |
| 44 | 643 | 696 | 30 | 292 | 0.42 | 21512 | COMPARATIVE EXAMPLE |
| 45 | 480 | 594 | 5 | 250 | 0.42 | 13415 | COMPARATIVE EXAMPLE |

In the present invention examples (Test No. 1 to 21), the tensile strength of 480 MPa or more, the product of the tensile strength and the limit form height in the saddle-type stretch-flange test of 19500 mm·MPa or more, the percent brittle fracture at a punching time of less than 20%, and the fatigue limit ratio of 0.4 or more were obtained.

Test No. 22 to 27 each are a comparative example in which the chemical composition is out of the range of the present invention. In Test No. 22 to 24, the index of the stretch flangeability did not satisfy the target value. In Test No. 25, the total content of Ti and Nb was small, and thus the index of the stretch flangeability and the tensile strength did not satisfy the target values. In Test No. 26, the total content of Ti and Nb was large, and thus the workability deteriorated and cracks occurred during rolling. In Test No. 27, the total content of Ti and Nb was large, and thus the index of the stretch flangeability did not satisfy the target value.

Test No. 28 to 46 each are a comparative example in which the manufacturing conditions were out of a desirable range, and thus one or more of the structures observed by an optical microscope, the proportion of the crystal grains each having an intragranular misorientation of 5 to 14°, the average aspect ratio, and the density of carbides did not satisfy the range of the present invention. In Test No. 28 to 40, and 45, the proportion of the crystal grains each having an intragranular misorientation of 5 to 14° was small, and thus the index of the stretch flangeability did not satisfy the target value. In Test No. 41 to 44, the average aspect ratio of ellipses equivalent to the crystal grains was large, and thus the percent brittle fracture at a punching time became greater than 20%.

INDUSTRIAL APPLICABILITY

According to the present invention, it is possible to provide a steel sheet that is high in strength, has excellent stretch flangeability, and has a base metal and a punched portion each having a good fatigue property. The steel sheet of the present invention can prevent damage accompanying irregularities in a punched end face even when punching is performed under strict working conditions using abrasive shears or punch with a strict clearance. The steel sheet of the present invention is applicable to a member required to have strict stretch flangeability and have a fatigue property of a base metal and a punched portion while having high strength. The steel sheet of the present invention is a material suitable for the weight reduction achieved by thinning of automotive members and contributes to improvement of fuel efficiency and so on of automobiles, and thus has high industrial applicability.

The invention claimed is:

1. A steel sheet, comprising:

a chemical composition represented by, in mass %,

C: 0.008 to 0.150%,

Si: 0.01 to 1.70%,

Mn: 0.60 to 2.50%,

Al: 0.010 to 0.60%,

Ti: 0 to 0.200%,

Nb: 0 to 0.200%,

Ti+Nb: 0.015 to 0.200%,

Cr: 0 to 1.0%,

B: 0 to 0.10%,

Mo: 0 to 1.0%,

Cu: 0 to 2.0%,

Ni: 0 to 2.0%,

Mg: 0 to 0.05%,

REM: 0 to 0.05%,

Ca: 0 to 0.05%,

Zr: 0 to 0.05%,

P: 0.05% or less,

S: 0.0200% or less,

N: 0.0060% or less, and balance: Fe and impurities; and a structure represented by, by area ratio, ferrite: 30 to 95%, and bainite: 5 to 70%, wherein when a region that is surrounded by a grain boundary having a misorientation of 15° or more and has a circle-equivalent diameter of 0.3 μm or more is defined as a crystal grain, the proportion of crystal grains each having an intragranular misorientation of 5 to 14° to all crystal grains is 20 to 100% by area ratio, an average aspect ratio of ellipses equivalent to the crystal grains is 5 or less, and an average distribution density of the total of Ti-based carbides and Nb-based carbides each having a grain size of 20 nm or more on ferrite grain boundaries is 10 carbides/μm or less.

2. The steel sheet according to claim 1, wherein a tensile strength is 480 MPa or more, the product of the tensile strength and a limit form height in a saddle-type stretch-flange test is 19500 mm·MPa or more, and a percent brittle fracture of a punched fracture surface is less than 20%.

3. The steel sheet according to claim 1, wherein the chemical composition contains, in mass %, one type or more selected from the group consisting of Cr: 0.05 to 1.0%, and B: 0.0005 to 0.10%.

4. The steel sheet according to claim 1, wherein the chemical composition contains, in mass %, one type or more selected from the group consisting of Mo: 0.01 to 1.0%, Cu: 0.01 to 2.0%, and Ni: 0.01% to 2.0%.

5. The steel sheet according to claim 1, wherein the chemical composition contains, in mass %, one type or more selected from the group consisting of Ca: 0.0001 to 0.05%, Mg: 0.0001 to 0.05%, Zr: 0.0001 to 0.05%, and REM: 0.0001 to 0.05%.

6. The steel sheet according to claim 1, wherein a plating layer is formed on a surface of the steel sheet.

7. The steel sheet according to claim 6, wherein the plating layer is a hot-dip galvanizing layer.

8. The steel sheet according to claim 6, wherein the plating layer is an alloyed hot-dip galvanizing layer.

* * * * *